US011805826B2

(12) United States Patent
Bonin

(10) Patent No.: US 11,805,826 B2
(45) Date of Patent: Nov. 7, 2023

(54) PERSONAL IMPACT PROTECTION DEVICE

(71) Applicant: WB Development Company LLC, Marlborough, MA (US)

(72) Inventor: Walter T. Bonin, Marlborough, MA (US)

(73) Assignee: WB Development Company, LLC, Marlborough, MA (US)

( * ) Notice: Subject to any disclaimer, the term of this patent is extended or adjusted under 35 U.S.C. 154(b) by 157 days.

(21) Appl. No.: 16/443,462

(22) Filed: Jun. 17, 2019

(65) Prior Publication Data

US 2019/0297965 A1 Oct. 3, 2019

Related U.S. Application Data

(63) Continuation-in-part of application No. 13/766,828, filed on Feb. 14, 2013, now Pat. No. 10,321,724.

(60) Provisional application No. 61/599,566, filed on Feb. 16, 2012.

(51) Int. Cl.

| | |
|---|---|
| ***A41D 13/015*** | (2006.01) |
| ***A42B 3/06*** | (2006.01) |
| ***A41D 13/06*** | (2006.01) |

(52) U.S. Cl.

CPC ..... *A41D 13/015* (2013.01); *A41D 13/065* (2013.01); *A42B 3/064* (2013.01); *A42B 3/065* (2013.01)

(58) Field of Classification Search

CPC .... A41D 13/015; A41D 13/065; A42B 3/064; A42B 3/065; A61F 5/0123; A61F 5/0125

USPC ..... 2/411

See application file for complete search history.

(56) References Cited

U.S. PATENT DOCUMENTS 573,919 A * 12/1896 Rice ..... A41D 13/065 2/24
1,087,863 A * 2/1914 Andrews ..... A41D 13/065 2/24
1,199,629 A * 9/1916 Name not available ..... A42B 3/145 2/418
1,244,559 A * 10/1917 Name not available ..... A42B 3/064 2/6.8
1,269,829 A * 6/1918 Lumley ..... A41D 13/065 2/24

(Continued)

OTHER PUBLICATIONS

Dictionary.com definition of Couple, www.dictionary.com printed on Jan. 11, 2022 (Year: 2022).*

(Continued)

*Primary Examiner* — Alissa L Hoey
(74) *Attorney, Agent, or Firm* — Duquette Law Group

(57) ABSTRACT

An impact protection device includes a first shell configured to be disposed on a body portion of a user, a second shell spaced at a distance from the first shell, and a set of elastomeric members spanning the distance between the first shell and the second shell. Each elastomeric member includes a first end and an opposing second end, each first end comprises a first end portion disposed within a corresponding opening defined by the first shell and a terminal portion disposed against an inner wall of the first shell and each second end connected to the second shell. The set of elastomeric members are configured to stretch between the first shell and the second shell in response to a translation of the second shell relative to the first shell and at a location that is substantially opposite to an impact receiving location of the second shell.

9 Claims, 35 Drawing Sheets

(56) References Cited

U.S. PATENT DOCUMENTS 1,293,240 A * 2/1919 Summers ..... A41D 13/0568 2/24
1,785,213 A * 12/1930 Shotwell ..... A41D 13/0568 2/24
3,237,201 A 3/1966 Morgan
3,687,440 A * 8/1972 Jarret ..... F16F 1/422 267/141
3,806,106 A * 4/1974 Hamel ..... F16F 1/371 267/152
3,872,511 A * 3/1975 Nichols ..... A42B 3/121 2/413
3,877,076 A * 4/1975 Summers ..... A42B 3/124 2/414
4,032,127 A * 6/1977 Lipfert ..... A61G 7/0573 267/151
4,407,021 A * 10/1983 Kralik ..... A42B 3/14 2/416
5,204,998 A * 4/1993 Liu ..... F16F 1/3732 2/411
5,853,844 A * 12/1998 Wen ..... A43B 13/181 428/119
6,378,140 B1 * 4/2002 Abraham ..... A42B 3/064 2/411
6,401,260 B1 * 6/2002 Porth ..... A42B 1/004 2/171
6,821,230 B2 * 11/2004 Dalebout ..... A63B 22/0228 482/51
6,868,560 B2 * 3/2005 Bostock ..... A42B 3/06 2/411
8,316,512 B2 * 11/2012 Halldin ..... A42B 3/064 24/90.1
8,756,719 B2 * 6/2014 Veazie ..... A42B 3/064 2/411
8,955,169 B2 * 2/2015 Weber ..... A42B 3/064 2/411
9,194,452 B2 * 11/2015 Hawkins ..... F16F 3/12
9,314,062 B2 * 4/2016 Marz ..... F41H 1/04
9,388,873 B1 * 7/2016 Phipps ..... A47C 27/06
9,462,840 B2 * 10/2016 Leon ..... A42B 3/06
9,545,125 B2 * 1/2017 Yoon ..... A41D 13/015
9,648,920 B1 * 5/2017 Kuntz ..... A42B 3/20
9,949,523 B2 * 4/2018 Klein ..... A42B 3/20
10,342,280 B2 * 7/2019 Valentino, Sr. ..... A42B 3/125
10,349,696 B2 * 7/2019 Ogata ..... A42B 3/063
10,350,477 B2 * 7/2019 Schneider ..... A63C 17/0046
10,362,829 B2 * 7/2019 Lowe ..... A42B 3/064
10,398,187 B1 * 9/2019 Shaffer ..... A42B 3/064
10,408,577 B2 * 9/2019 Pepka ..... F41H 5/013
10,441,008 B2 * 10/2019 Hamilton ..... A41D 13/08
10,660,390 B2 * 5/2020 Ku ..... A42B 3/14
10,966,479 B2 * 4/2021 Browd ..... A42B 3/121
11,197,511 B2 * 12/2021 Keevy ..... A42B 3/127
11,304,470 B2 * 4/2022 Kele ..... A42B 3/066
2007/0068755 A1 * 3/2007 Hawkins ..... F41H 5/023 188/371
2007/0190293 A1 * 8/2007 Ferrara ..... B32B 3/266 428/166
2008/0256686 A1 * 10/2008 Ferrara ..... B60R 19/20 2/413
2010/0186150 A1 * 7/2010 Ferrara ..... F16F 9/0481 2/412
2013/0019384 A1 * 1/2013 Knight ..... A41D 13/015 2/411
2013/0042397 A1 * 2/2013 Halldin ..... A42B 3/125 2/411
2013/0061371 A1 * 3/2013 Phipps ..... A42B 3/064 2/411
2013/0145521 A1 * 6/2013 Spicuzza ..... A41B 11/007 2/239
2013/0185837 A1 * 7/2013 Phipps ..... A42B 3/20 2/2.5
2013/0234376 A1 * 9/2013 Frey ..... A41D 13/015 267/141
2014/0000012 A1 * 1/2014 Mustapha ..... A42B 3/064 2/414
2014/0109299 A1 * 4/2014 Kwan ..... A42B 3/04 2/413
2014/0208486 A1 * 7/2014 Krueger ..... A42B 3/064 2/414
2015/0089724 A1 * 4/2015 Berry ..... A42B 3/064 2/414
2015/0157083 A1 * 6/2015 Lowe ..... A42B 3/064 2/412
2015/0208751 A1 * 7/2015 Day ..... A42B 3/064 2/414
2015/0223547 A1 * 8/2015 Wibby ..... A42B 3/064 2/414
2016/0021965 A1 * 1/2016 Mayerovitch ..... A42B 3/064 2/414
2016/0161222 A1 * 6/2016 Lee ..... A42B 3/14 2/416
2016/0278470 A1 * 9/2016 Posner ..... A42B 3/064
2017/0105470 A1 * 4/2017 Eaton ..... A42B 3/122
2017/0295880 A1 * 10/2017 Kennedy ..... F16F 15/08
2017/0303622 A1 * 10/2017 Stone ..... A42B 3/125
2018/0000186 A1 * 1/2018 Brown ..... A41D 13/05
2018/0056168 A1 * 3/2018 Sodec, Jr. ..... A63B 71/10
2018/0184745 A1 * 7/2018 Stone ..... A42B 3/128
2018/0228239 A1 * 8/2018 Day ..... A42B 3/064
2019/0133235 A1 * 5/2019 Domanskis ..... A42B 3/0473
2019/0159540 A1 * 5/2019 Pradeep ..... A42B 3/125
2019/0328073 A1 * 10/2019 Morgan ..... A42B 3/124
2020/0022444 A1 * 1/2020 Stone ..... A42B 3/062
2020/0146385 A1 * 5/2020 Young ..... A42B 3/062
2020/0163398 A1 * 5/2020 Baker ..... A42B 3/062
2020/0187581 A1 * 6/2020 Roundtree ..... A42B 3/125

OTHER PUBLICATIONS

Dictionary.com definition of Join, www.dictionary.com printed on Jan. 11, 2022 (Year: 2022).*

* cited by examiner

PERSONAL IMPACT PROTECTION DEVICE

CROSS-REFERENCE TO RELATED APPLICATION

This application is a continuation-in-part of U.S. application Ser. No. 13/766,828, filed on Feb. 14, 2013 and entitled "Personal Impact Protection Device," which claims priority to Provisional Application Ser. No. 61/599,566, filed on Feb. 16, 2012, the contents and teachings of each of which are hereby incorporated by reference in their entirety.

FIELD

This disclosure relates to an impact protection device that is worn on the person.

BACKGROUND

Helmets, shoulder pads, thigh pads and other protective gear is used by people in various situations to help protect the body from injury due to impacts. In contact sports such as football, hockey and lacrosse, impacts to the head can be especially problematic.

Protective gear typically aims to absorb impact energy through the use of compressive pads. Such pads do absorb some energy, but are not sufficient. One problem is that when pads reach their compression limit they lose effectiveness. Another problem is that only the portion of the pad directly under the impact location, and areas close to the impact location, is compressed, which limits the pad volume involved in energy absorption and thus limits its effectiveness.

SUMMARY

This disclosure features a personal impact protection device comprising a first mechanical member, a second mechanical member spaced from the first mechanical member, and one or more elastomeric energy-absorption members mechanically coupled to and spanning the distance between both of the mechanical members. The mechanical members may be nested and may be generally concentric. The first mechanical member may comprise a first shell that is constructed and arranged to be placed on the head, and the second mechanical member may comprise a second shell that substantially surrounds and is spaced from the first shell. The impact protection device may further comprise a facemask that is mechanically coupled to the second shell. The energy-absorption members may be thin, flat sheet members or elongated straps. The impact protection device may be, for example, a helmet, a knee protector or a thigh protector.

The impact protection device may further comprise one or more energy absorption subassemblies. The energy absorption subassemblies may comprise generally concentric spaced rings comprising an inner ring and an outer ring, and a plurality of the energy-absorption members mechanically coupled to both the inner ring and the outer ring and spanning the distance between the rings. The energy-absorption members that are coupled to the spaced rings may be generally annular. The energy-absorption members that are coupled to the spaced rings may themselves be spaced around at least most of the circumferences of the inner and outer rings. The inner ring may be fixed to the outside of the first mechanical member, and the outer ring may be fixed to the inside of the second mechanical member. The energy-absorption members may be elastomeric strips that are coupled together at one end and free from each other at the other end. Some of the energy-absorption members may be longer than other members. Some of the energy-absorption members may be stronger than other members.

The first mechanical member may comprise a first inner ring and the second mechanical member may comprise a first outer ring spaced from and surrounding the first inner ring; a plurality of the energy-absorption members may be mechanically coupled to both the first inner ring and the first outer ring and span the distance between such rings. The impact protection device may further comprise a first shell to which the first outer ring is mechanically coupled. The impact protection may further comprise a second inner ring and a second outer ring spaced from and surrounding the second inner ring, and a plurality of energy-absorption members mechanically coupled to both the second inner ring and the second outer ring and spanning the distance between such rings. The impact protection device may further comprise a second shell to which the second outer ring is mechanically coupled. The first shell and the second shell may be connected by a hinge that is located between the shells. The first shell and the second shell may each be constructed and arranged to be attached to clothing covering a leg, with one shell above the knee and the other shell below the knee and the hinge proximate the knee.

Also featured in this disclosure is a helmet comprising a first shell that is constructed and arranged to be placed on the head, a second shell that substantially surrounds and is spaced from the first shell, one or more energy absorption subassemblies located between the first and second shells, each energy absorption subassembly comprising generally concentric spaced rings comprising an inner ring and an outer ring and a plurality of elastomeric energy-absorption members mechanically coupled to both the inner ring and the outer ring and spanning the distance between the rings; the energy-absorption members are spaced around at least most of the circumferences of the inner and outer rings. The inner ring of each energy absorption subassembly is fixed to the outside of the first shell, and the outer ring of each energy absorption subassembly is fixed to the inside of the second shell.

Further featured herein is an impact protection device for protection of a knee comprising two energy absorption subassemblies, each energy absorption subassembly comprising generally concentric spaced rings comprising an inner ring and an outer ring, and a plurality of elastomeric energy-absorption members mechanically coupled to both the inner ring and the outer ring and spanning the distance between the rings; the energy-absorption members are spaced around at least most of the circumferences of the inner and outer rings. There is a first housing to which the outer ring of a first energy absorption subassembly is mechanically coupled, and a second housing to which the outer ring of the second energy absorption subassembly is mechanically coupled. The first housing and the second housing are each constructed and adapted to be attached to clothing covering a leg, with one housing above the knee and the other housing below the knee. The first housing and the second housing are connected by a hinge that is located between the housings and proximate the knee.

Embodiments of the innovation can relate to an impact protection device which includes a first shell configured to be disposed on a body portion of a user, a second shell spaced at a distance from the first shell, and a set of elastomeric members spanning the distance between the first shell and the second shell. Each elastomeric member includes a first end and an opposing second end, each first end comprises a first end portion disposed within a corresponding opening defined by the first shell and a terminal portion disposed against an inner wall of the first shell and each second end connected to the second shell. The set of elastomeric members are configured to stretch between the first shell and the second shell in response to a translation of the second shell relative to the first shell and at a location that is substantially opposite to an impact receiving location of the second shell.

Embodiments of the innovation can relate to an impact protection device which includes a first shell configured to be disposed on a body portion of a user, a second shell spaced at a distance from the first shell, and at least one energy absorption subassembly disposed between the first shell and the second shell. The at least one energy absorption subassembly comprises a first component, a second component spaced at a distance from the first component, and a set of elastomeric members spanning the distance between the first component and the second component. Each elastomeric member of the set of elastomeric members includes a first end and an opposing second end, the first end coupled to the first component and the first shell and the second end coupled to the second component and the second shell. The set of elastomeric members are configured to stretch between the first component and the second component in response to a translation of the second shell relative to the first shell and at a location that is substantially opposite to an impact receiving location of the second shell.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

The innovation set forth in this disclosure may be accomplished in a personal impact protection device. The personal impact protection device uses one or more elastomeric energy-absorption members that are mechanically coupled to two spaced nested mechanical members or shells that act as impact areas, and also can act as anchor points and supports for the elastomeric members. One of the two mechanical members is coupled to a person's body. The coupling can be to clothing worn by the person or directly to the body of the person. The coupling can be accomplished by means such as elastic straps. When the impact protection device undergoes impact to the second or outer member, the second mechanical member (that is not coupled to the body) is moved relative to the first mechanical member. This movement causes the spacing between the members to change: on the side of the members away from the impact, the spacing between the members increases. This causes the elastomeric members located in the region in which the spacing has increased to stretch. As the elastomeric members stretch, they absorb momentum and thus lower the force felt by the person wearing the device. The impact protection device thus helps to protect the person from injury caused by the impact.

Figure 1A:
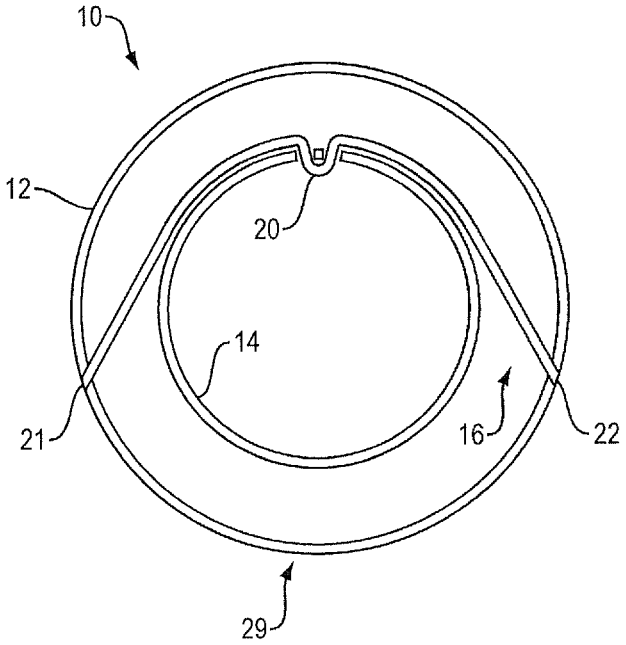
FIG. 1A is a highly schematic cross-sectional representation of a personal impact protection device in the at-rest position.
Figure 1B:
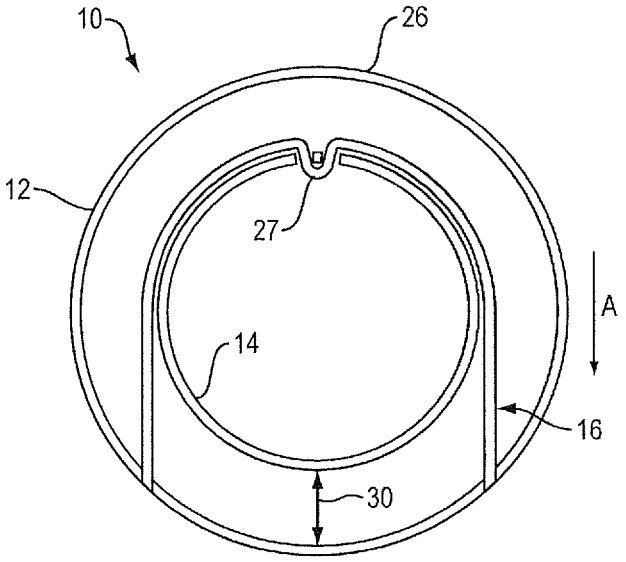
FIG. 1B is a view of the same device under impact.

Personal impact protection device 10 is schematically depicted in FIGS. 1A and 1B. Device 10 includes outer mechanical member or shell 12 that substantially or fully surrounds, and is spaced from, inner mechanical member or shell 14. The shells are preferably nested together and they may or may not be concentric. Shells 12 and 14 are sized and shaped and made from a material that is sufficient for the intended application of device 10. Different applications are described below. Typically, shells 12 and 14 are made from a molded plastic material such as polycarbonate. Device 10 includes one or more elastomeric energy absorption members. In this example, one member 16 provides the compliance and energy absorption functions. Member 16 in this case is a thin, flat piece of elastomeric material that may take the form of a strap or sheet of material. One material may be butyl rubber. Other materials, sizes, shapes and thicknesses are contemplated depending on the overall construction of the impact protection device, the arrangement of and distances between the first and second mechanical members, and the amount of force and the locations and directions of impact that are designed to be ameliorated by the device.

Energy-absorption member 16 is anchored to shell 12 at locations 21 and 22 and anchored to shell 14 at location 20. Upon inwardly-directed impact against shell 12 at or proximate location 26, shell 12 is pushed in the direction of arrow "A" relative to shell 14, which is stationary or largely stationary due to it being coupled to clothing or the body. The impact thus increases the distance between the shells at the side opposite the impact location, indicated by increased gap 30. This motion causes member 16 to stretch, which absorbs energy. In an ideal situation, all of the impact energy is absorbed by member 16. Even if less than all of the energy is absorbed, the energy absorption decreases the amount of energy transferred to the body in and around area 27 proximate the area of impact 26.

Figure 2:
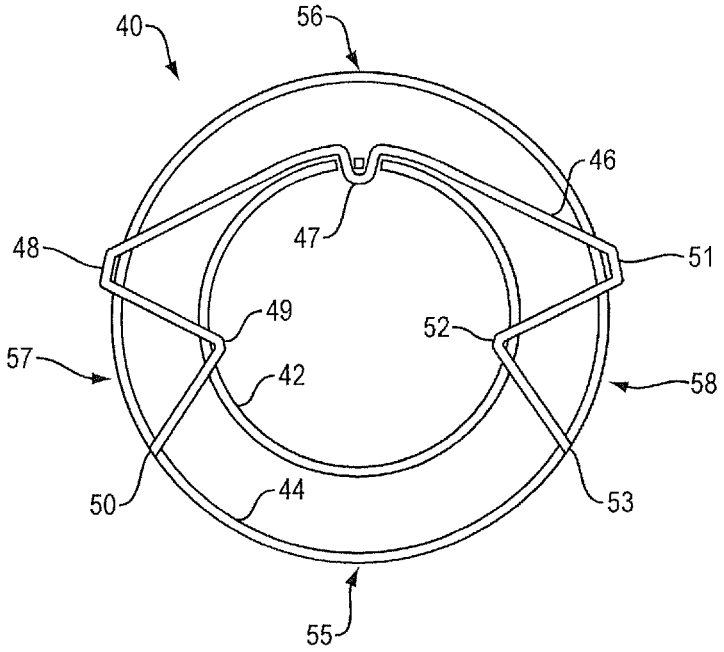
FIG. 2 is a similar view of an alternative arrangement of a personal impact protection device.

The personal impact protection device can be constructed and arranged to absorb impact energy from all directions and angles, or from less than all. The example shown in FIGS. 1A and 1B would do little to absorb impact energy from direction 29 or another direction in which energy-absorption members are folded or compressed as opposed to being stretched, as the elastomeric energy-absorption members will simply bend or fold if they are compressed. This property of relatively thin and elongated elastomeric members can be ameliorated by arranging the one or more energy-absorption members such that they are stretched when the impact protection device is impacted in a particular location and/or direction. As one simple example, FIG. 2 depicts a personal impact protection device 40 that will absorb energy from impact around the entire circumference of outer member or shell 44. For impacts at the front area 56, rear area 55 and the lateral areas 57 and 58, elastomeric energy absorption member 46 will be stretched and thus absorb energy. This is accomplished by anchoring single elastomeric member 46 at points 47-53 to both the inner mechanical member or shell 42 and the outer mechanical member or shell 44. The same function could be accomplished with a plurality of elastomeric energy-absorption members that are mechanically coupled to both the inner and outer shells and located at locations in which the outer shell will be pushed away from the inner shell upon impact: in other words, in locations other than at the impact or expected impact location. Obviously if impact can be expected at any point around the circumference of the impact protection device, elastomeric energy-absorption members should be spaced around at least most of or all of the circumferences of the inner and outer shells. Other energy absorption means such as traditional compressible cushioning (not shown), can potentially be added, to augment the elastomeric-based energy absorption by locating the cushioning between the energy absorption members at the expected impact areas.

The personal impact protection device may include one or more energy-absorption subassemblies. Broadly, an energy-absorption subassembly can be an assembly that carries one or more elastomeric energy-absorption members and that is constructed and arranged to be mechanically coupled to and located between the first and second mechanical members or shells. The energy-absorption subassemblies thus can assist with the ease of manufacturing or assembly of the personal impact protection device.

Figure 3A:
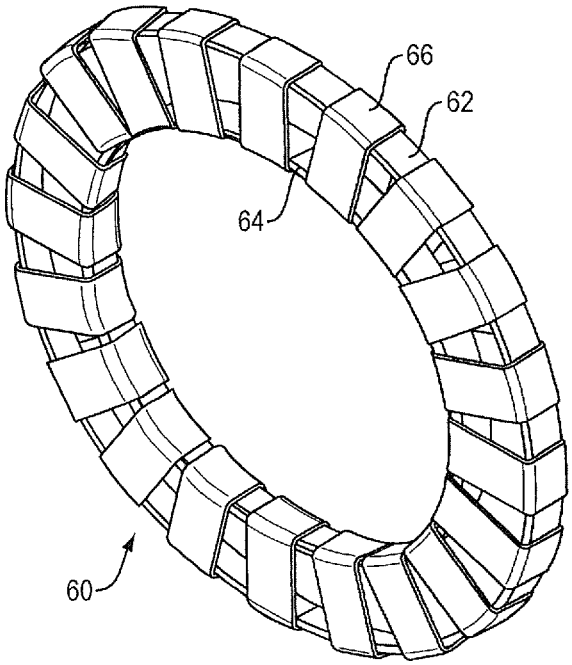
FIGS. 3A and 3B are perspective and top views, respectively, of an energy-absorption subassembly for a personal impact protection device.
Figure 3C:
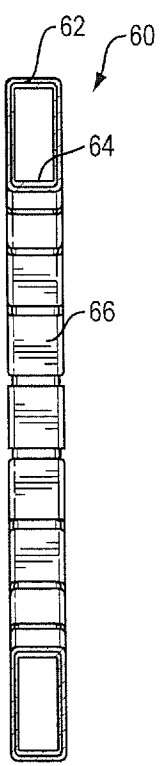
FIG. 3C is a cross-sectional view taken along line A-A of FIG. 3B.
Figure 3B:
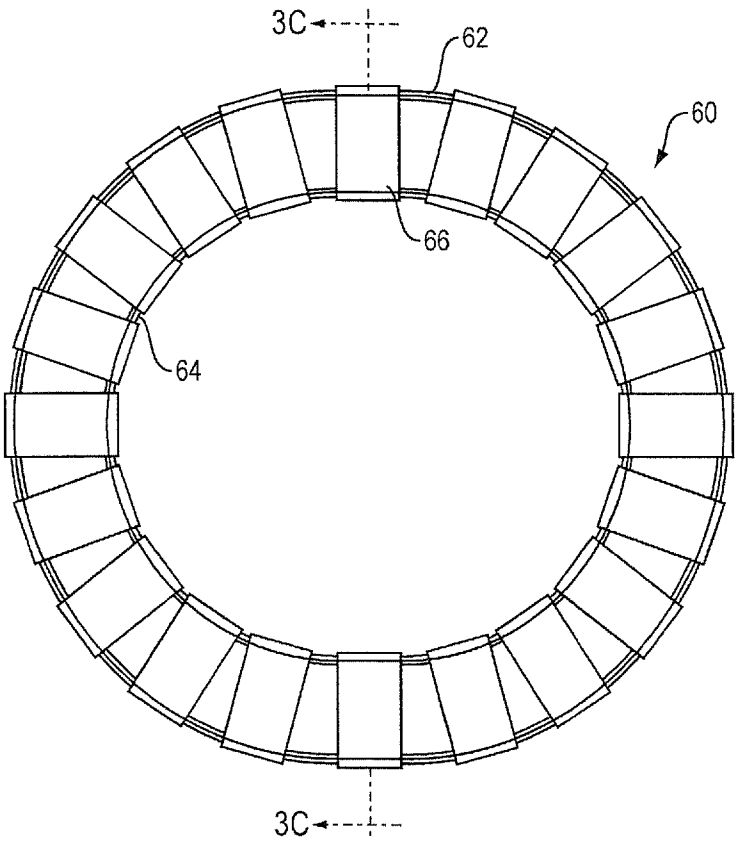

In a non-limiting embodiment shown in FIGS. 3A-3C, energy-absorption subassembly 60 comprises generally concentric spaced annular rings comprising an inner ring 64 and an outer ring 62. A plurality of energy-absorption members 66 are mechanically coupled to both the inner and outer ring and span the distance between the rings. In this example, members 66 are annular pieces of elastomeric material. Members 66 can be created, for example, through extrusion, or by cutting an elastomeric tube of the correct diameter into pieces of a desired width. Members 66 can be anchored to the rings or not, can be a desired thickness and width and/or material, and can be located at desired locations and spaced in a desired manner to accomplish a particular amount of energy-absorption at one or more desired locations of the subassembly. For example, stronger elastomers can be placed with some slack such that they begin to stretch only close to the endpoint of travel of the outer ring (or the outer mechanical assembly); this would be useful for heavy impacts that otherwise would cause the rings (or mechanical members) to come into contact and thus prevent further energy absorption. Multiple elastomeric members of different lengths and/or different strengths can be located in parallel so that their energy-absorption is cumulative.

The subassembly can be mechanically coupled to the mechanical members/shells in a desired fashion, such as by riveting or using other fasteners. Typically, outer ring 62 would be fixed into the inside of the outer shell, and inner ring 64 would be fixed to the outside of the inner shell. Subassembly 60 thus would establish the gap between the inner and outer mechanical members/shells.

The circular subassembly is not necessary. A similar result can be accomplished by using a number of smaller subassemblies each comprising spaced structural members that are adapted to support one or more elastomers, e.g., with one or two elastomers to each subassembly. The subassemblies can be arc-shaped, or can take another shape that is appropriate for the space between shells in which they are to be located. They can be distributed anywhere in the helmet or other personal impact protection device. They can be attached to any helmet of any size using standard mechanical fasteners such as rivets. The elastomer is tubular, like a piece of a bicycle inner tube. The tubes slip over the structural members of the subassembly, and the subassemblies are then attached to each shell. The absorption strength of a subassembly can be changed simply by using a longer tube. The distance between the shells can be any length, say from 1 to 3 inches, using standard parts. A three inch elastomer has nine times the absorption of a lone inch elastomer. More generally, subassembly 60 can be divided into individual subassemblies as may be desirable to achieve a particular result.

Figure 4:
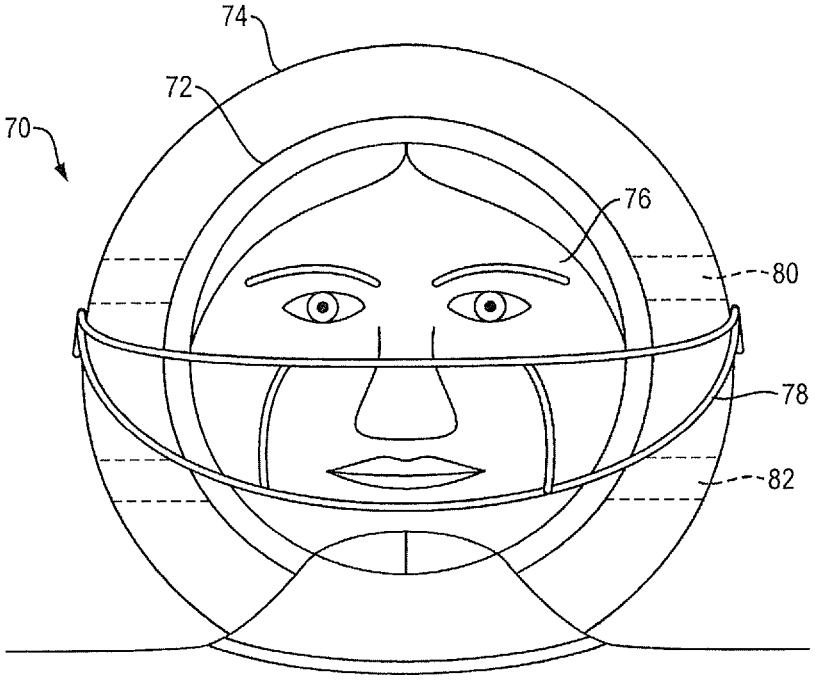
FIG. 4 is a highly schematic representation of a helmet worn on the head to protect the head.

One particular embodiment of the personal impact protection device is a helmet that is constructed and arranged to be worn on the head of a user to protect the head from impact injury. Helmet 70, FIGS. 4 and 5, comprises first or inner shell 72 that is constructed and adapted to be placed on head 76. This placement anchors shell 72, ideally such that it does not move, or at least is constrained from movement in six degrees of freedom. Outer shell 74 is spaced from and substantially surrounds inner shell 72. In this example, two energy-absorption subassemblies 80 and 82 are located in the space between shells 72 and 74. Subassemblies 80 and 82 generally have the same construction as subassembly 60, FIG. 3. If subassembly 80 is located in the helmet around the forehead region, where the helmet encircles the head, it can be fully annular and can have elastomeric energy-absorption members around its entire periphery. Since second subassembly 82 is located in a region of the helmet that has an opening in front of the face, it is not fully annular but is more arc-shaped, encompassing an angle of around 180 to 270 degrees. Face mask 78 is mechanically coupled to outer shell 74, so that forces on the facemask are transferred to the outer shell and thus cause its motion, which results in forces being dispersed.

Figure 5A:
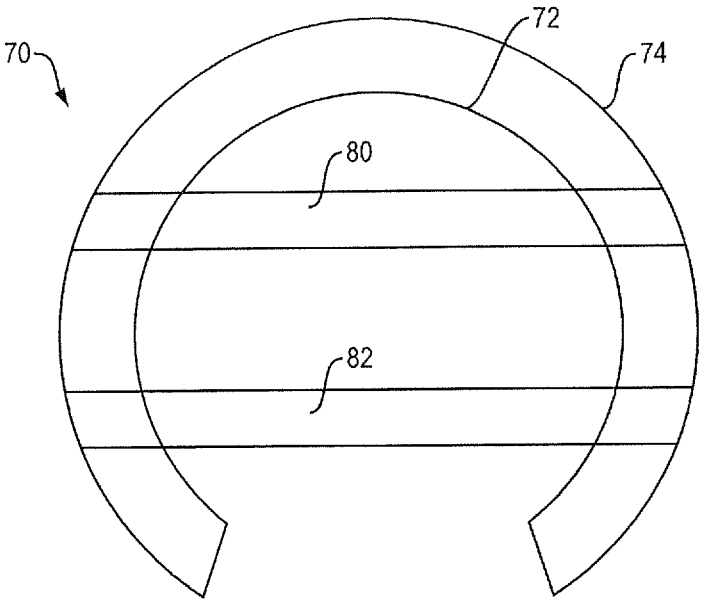
FIGS. 5A and 5B are schematic side views of the helmet of FIG. 4 in the at-rest and under-impact positions, respectively.
Figure 5B:
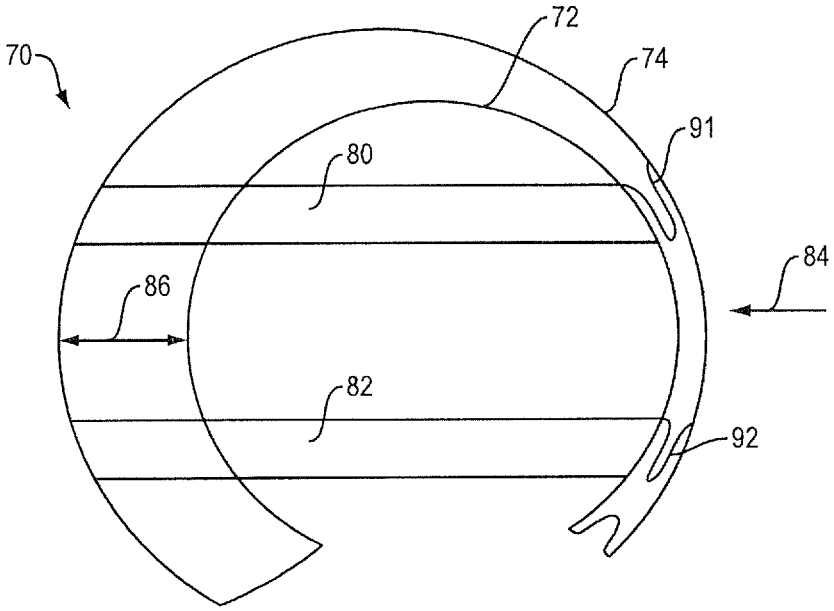

The operation of helmet 70 is schematically depicted in FIGS. 5A and 5B. FIG. 5A shows a rest position in which there is no impact on the helmet. FIG. 5B shows an impact 84 on the left side of helmet 70. The impact pushes shell 74 to the left, in other words, parallel to the direction of the impact. Since shell 72 is fixed to the head, it does not substantially move. The result is that gap 86 is increased, which stretches all of the elastomeric members of both subassemblies 80 and 82 that are on the right-hand side of the subassemblies, and to some extent, elastomeric members located at the front and rear of the helmet. This absorbs impact energy. Elastomeric members in the area of impact are folded or compressed as indicated by members 91 and 92; these contribute little or nothing to energy absorption.

Helmet 70 is also able to absorb blows borne from the bottom or top, and oblique blows that cause torque. Any impact that moves the outer ring of an energy-absorption subassembly relative to the inner ring will cause one or more elastomeric members to stretch, and thus absorb energy. Any motion of the outer shell that causes the stretching in any direction of one or more elastomeric members will absorb energy and thus help to ameliorate the effects of impact.

Figure 6A:
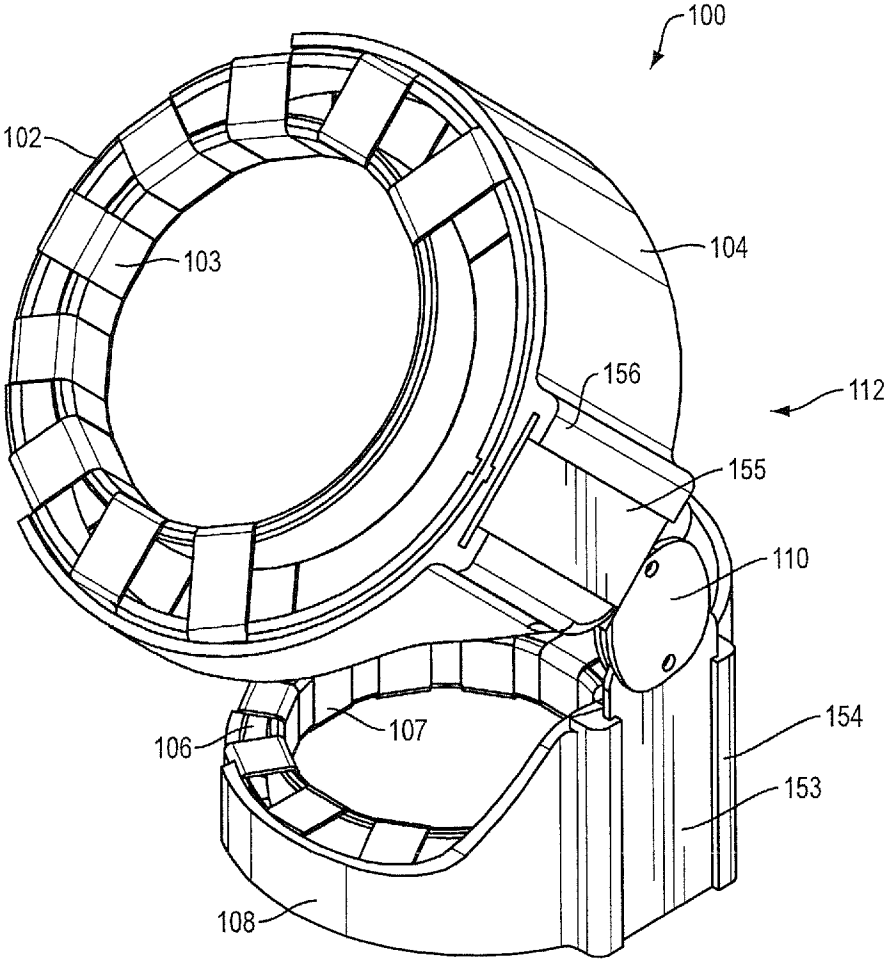
FIGS. 6A, 6B, 6C and 6D are perspective, side, front, and a second perspective view, respectively, of an impact protection device for protection of a knee.
Figure 6C:
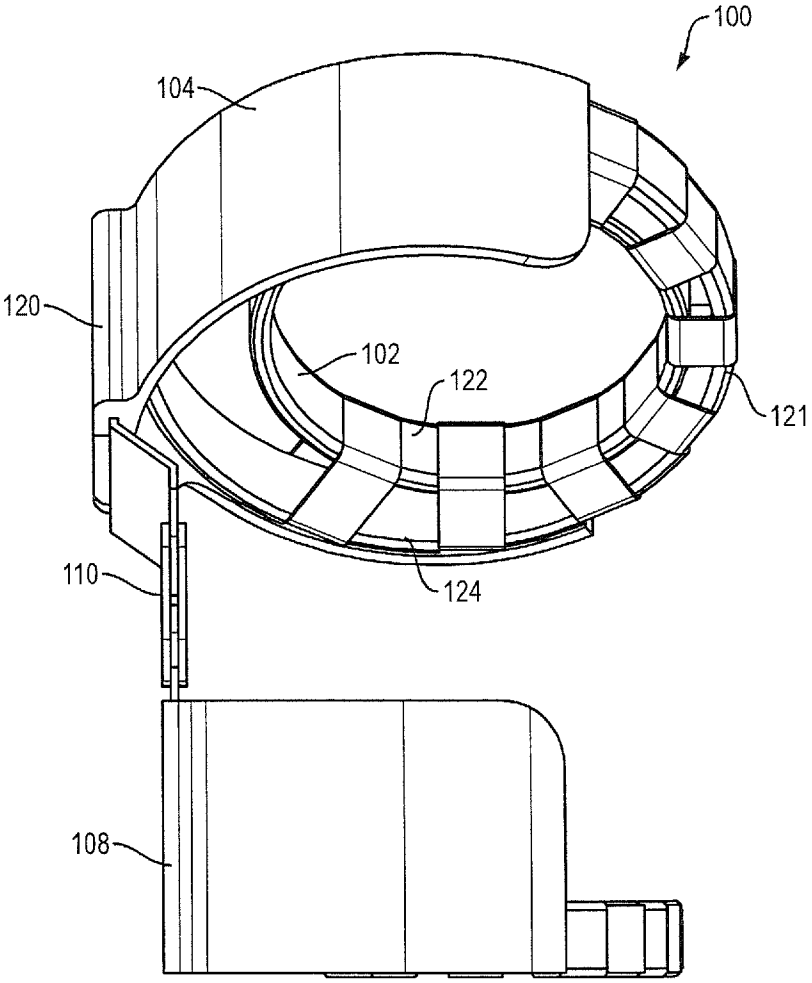
Figure 6B:
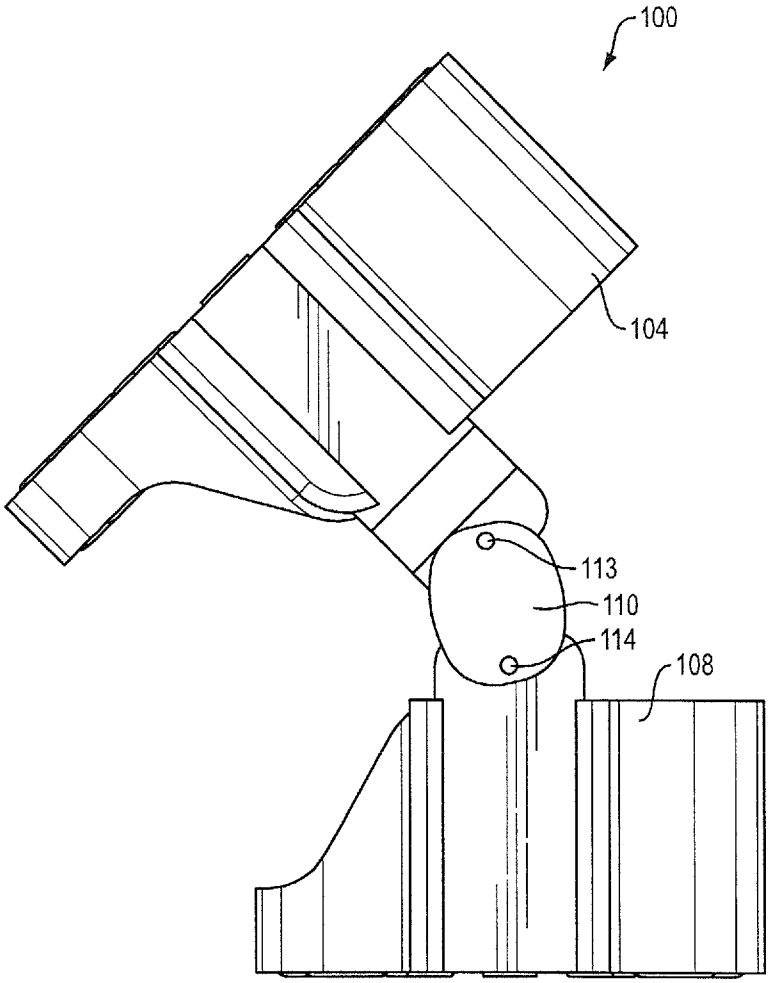
Figure 6D:
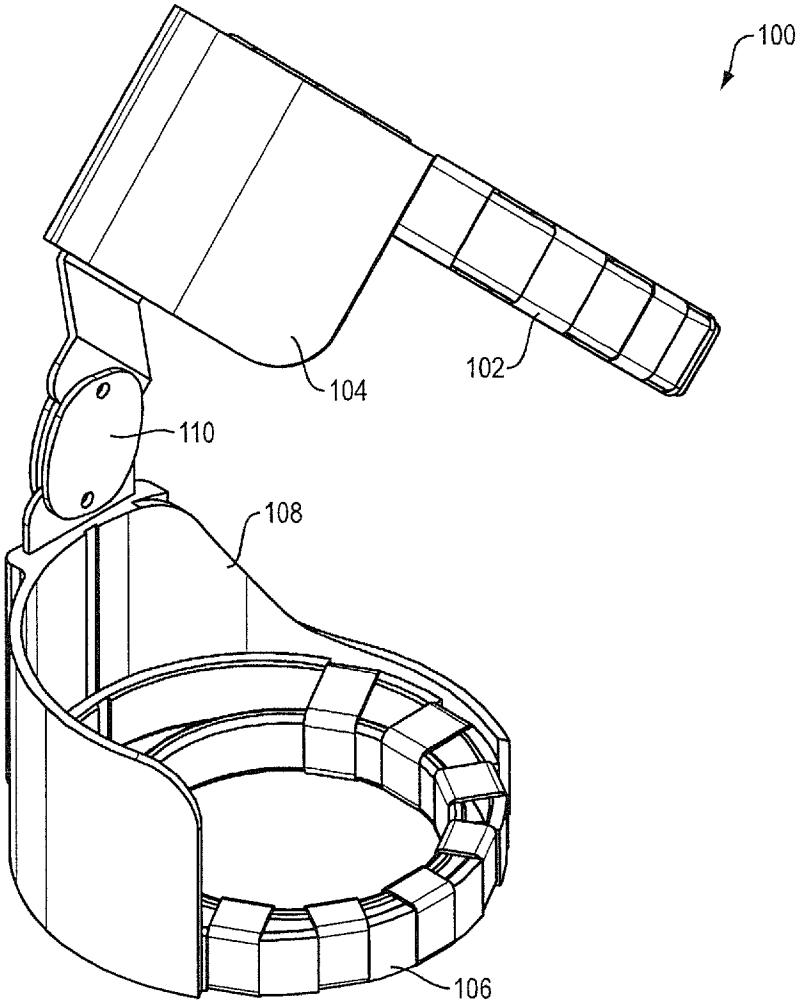
Figure 7:
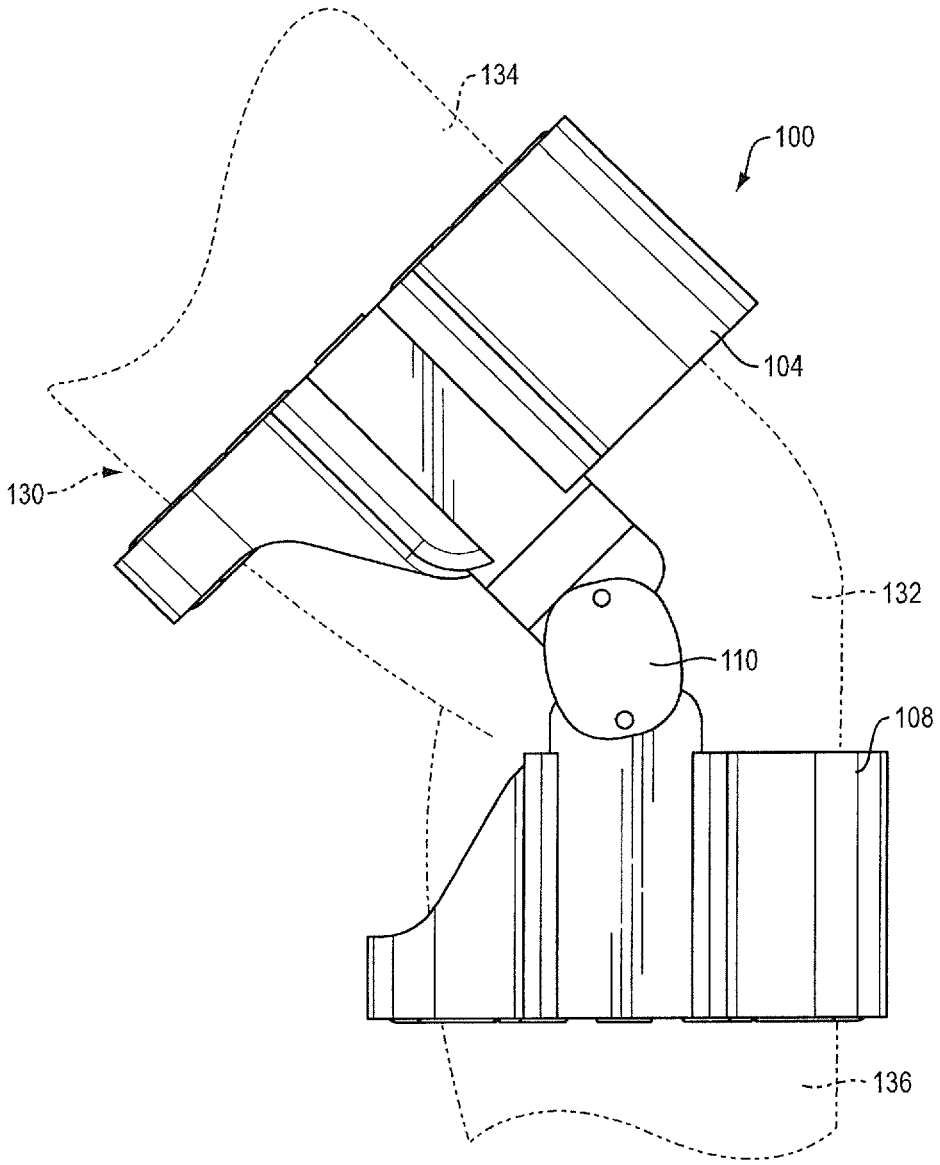
FIG. 7 shows the device of FIG. 6 in use.

A specific embodiment of an impact protection device for protection of a knee, is shown in FIGS. 6 and 7. Device 100 in this case comprises two energy absorption subassemblies 102 and 106. Each such subassembly is mechanically coupled to one of housings 104 and 108. The housings are interconnected by a pivot or hinge device 110 that allows housings 104 and 108 to pivot about one or more axes that are normal to the surface of hinge 110. Also, plates 153 and 155 that are directly coupled to hinge 110 are adapted to slide up and down within receiving channels 154 and 156, respectively, to give housings 104 and 108 the ability to move vertically; this allows for adjustment for comfort and fit, and also allows for greater freedom of movement of the user. In use as shown in FIG. 7, pivot 110 is placed proximate knee area 132 of leg 130. Hinge 110 could be covered by a protective cover or disk (not shown) to help prevent it from being damaged by impacts. Housing 104 is located above the knee, in thigh area 134. Housing 108 is located below the knee, in calf area 136. Device 100 is designed to help absorb the energy of impacts to the outside of the knee.

Device 100 is worn such that the side with the pivot and that defines a continuous portion of hinged housing assembly 112 is located along the outside as opposed to the inside of the wearer's knee, where impact is most likely to occur in a sport such as football. The housing assembly helps to transfer force at any location along the length of the assembly to one or both of the energy-absorption subassemblies 102 and 106. Assemblies 102 and 106 are arranged such that in the rest position shown in the drawings, there is a larger gap between the inner and outer rings 122, 124 on this outside area proximate portion 120 than on the opposite or inside portion 121. Since the gap in the area of impact defines the maximum travel of the outer ring 124 of the energy-absorption subassembly relative to the inner ring 122, having the inner and outer rings 122, 124 generally but not exactly concentric as in this case, can provide additional energy absorption in one direction, which in this case is impact to the outside of the knee area that can cause severe injury.

Housing 104 can pivot about axis 113. Housing 108 can pivot about axis 114. Structure 110 can pivot about axes 113 and 114. Elastomeric energy-absorption member 103 of subassembly 102 and elastomeric energy-absorption member 107 of energy absorption subassembly 106 are indicated in the drawings.

Figure 8A:
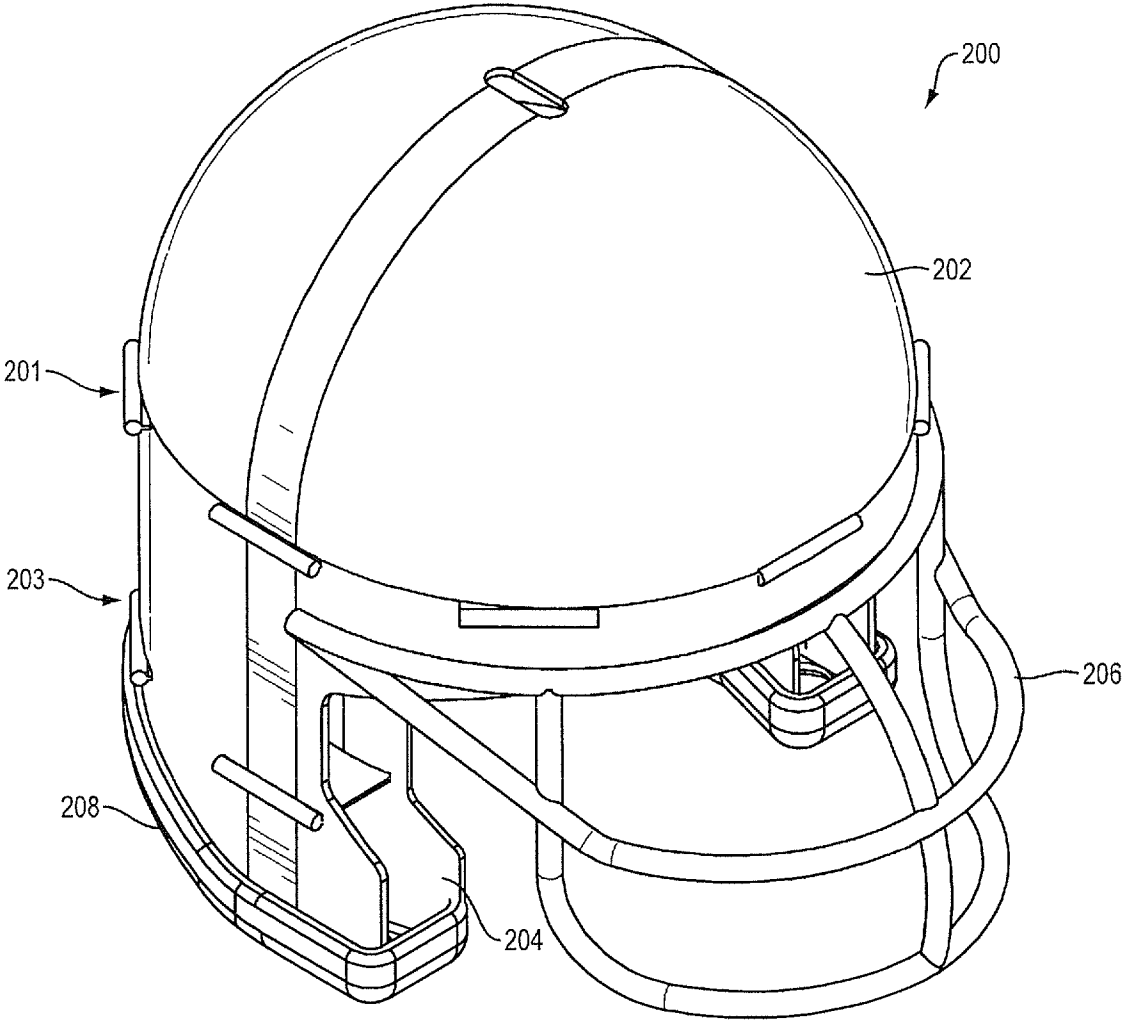
FIGS. 8A-8F are full perspective, hidden-detail perspective, side, top and two cross-sectional views, respectively, of a different helmet design.
Figure 8B:
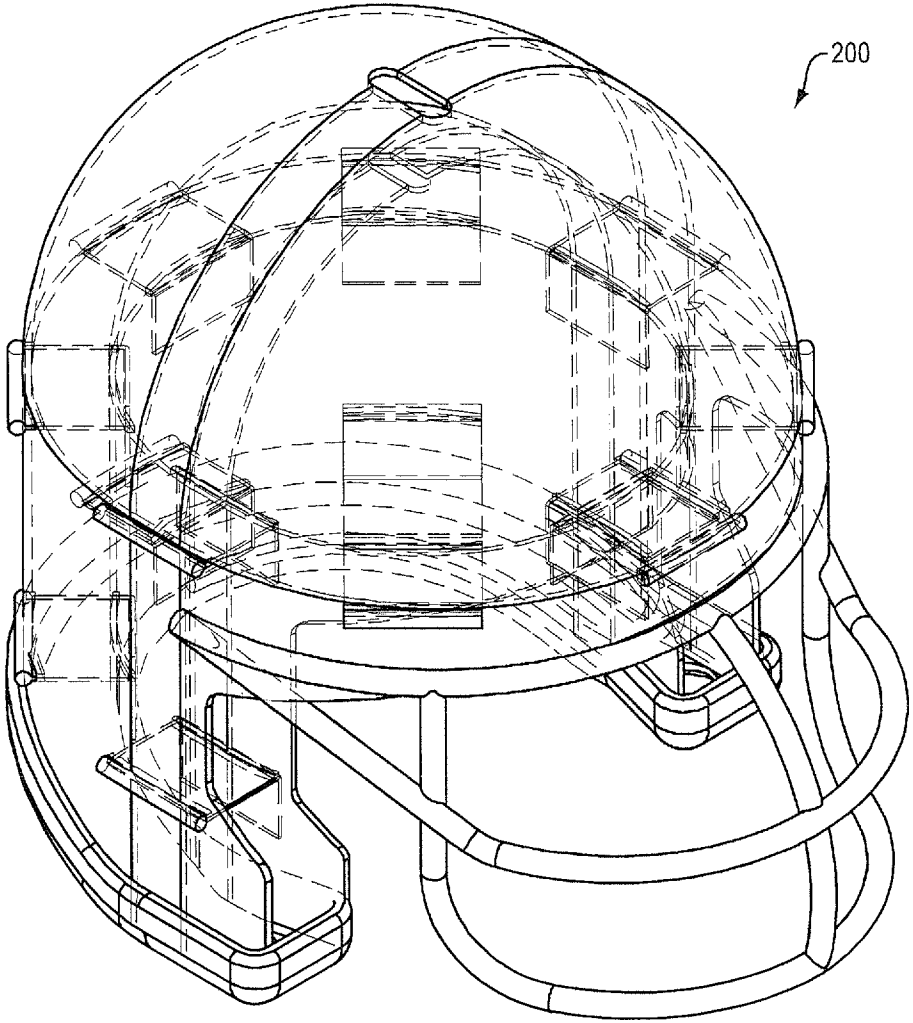
Figure 8C:
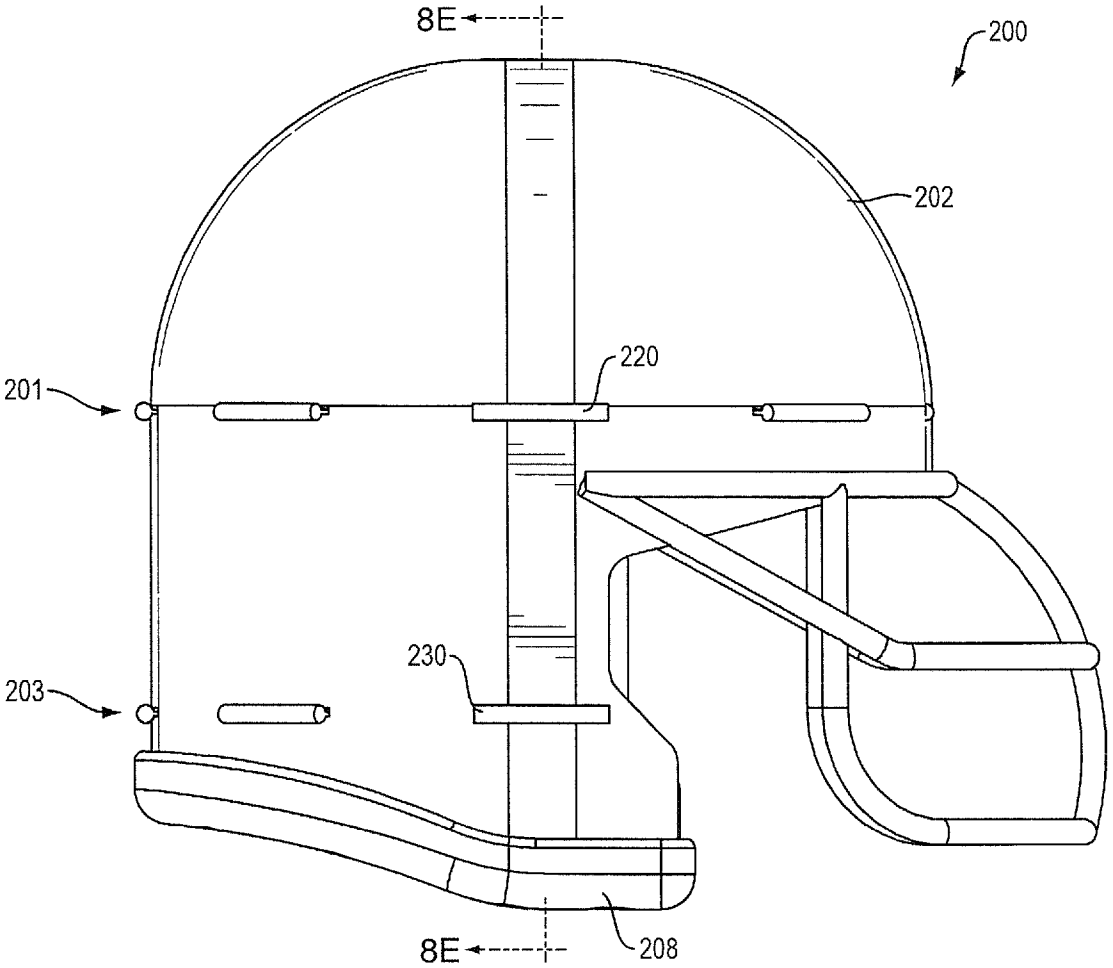
Figure 8D:
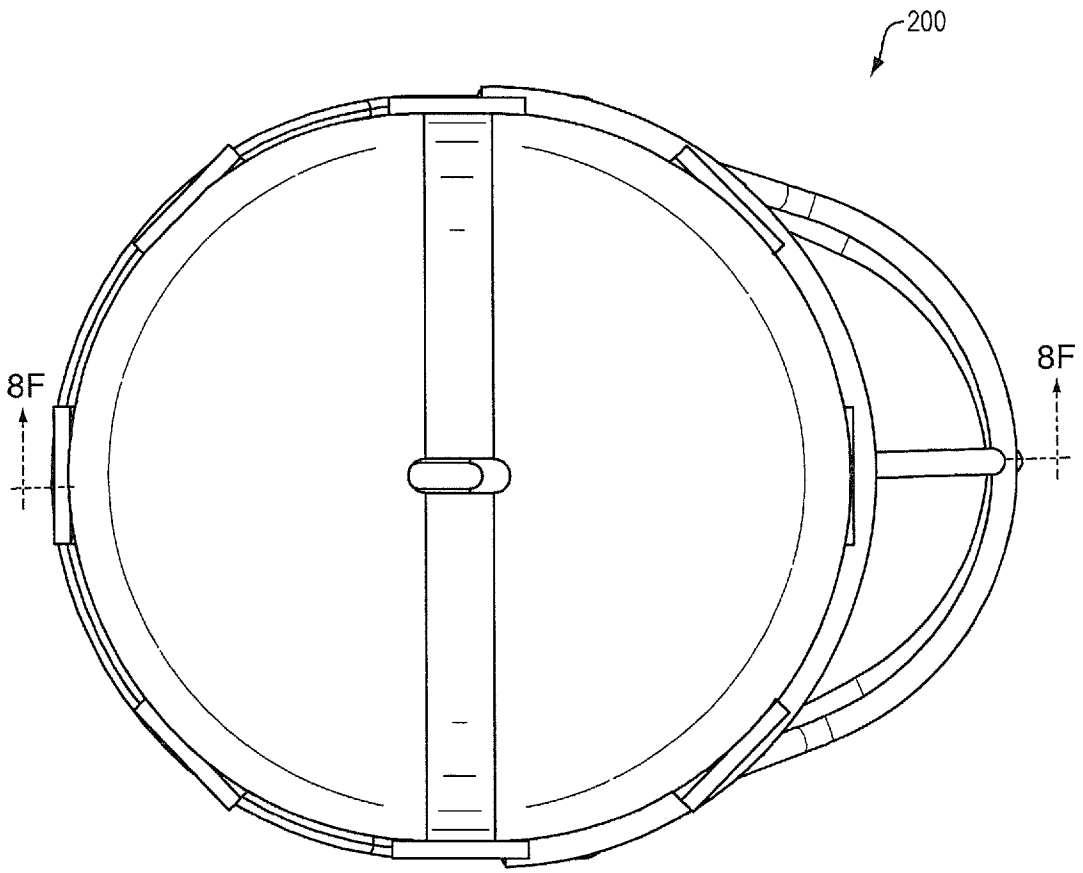
Figure 8E:
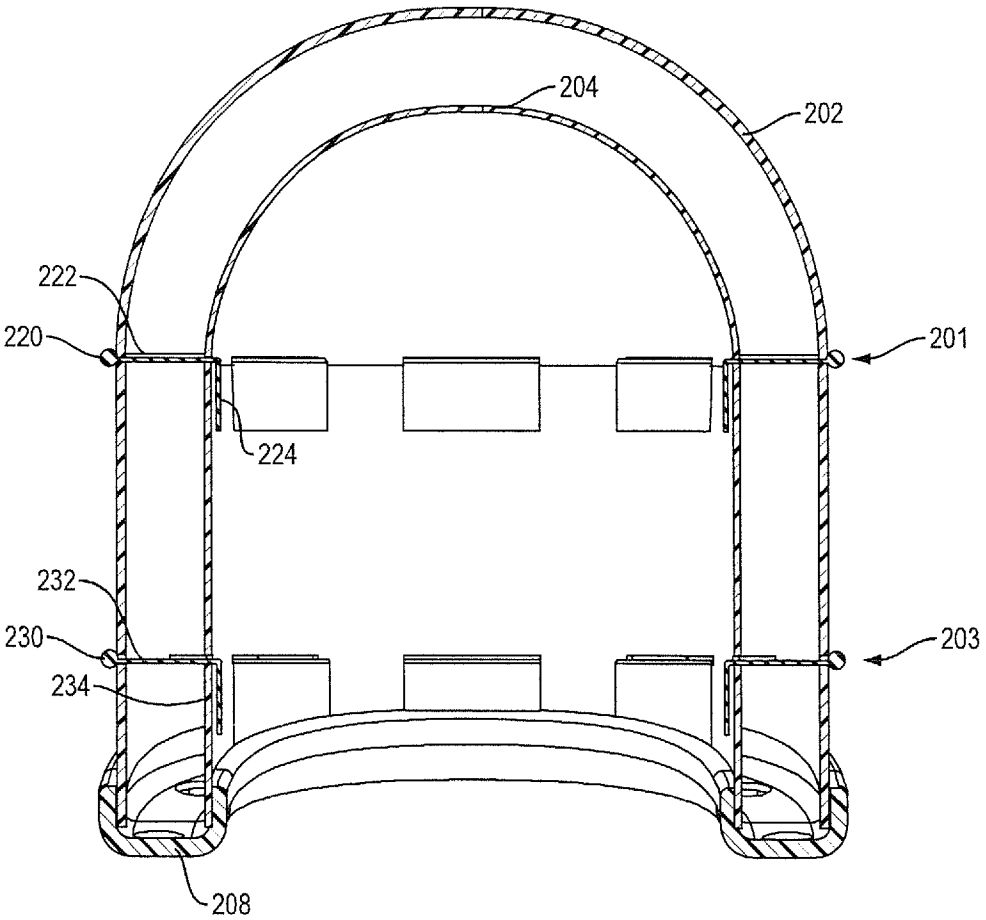
Figure 8F:
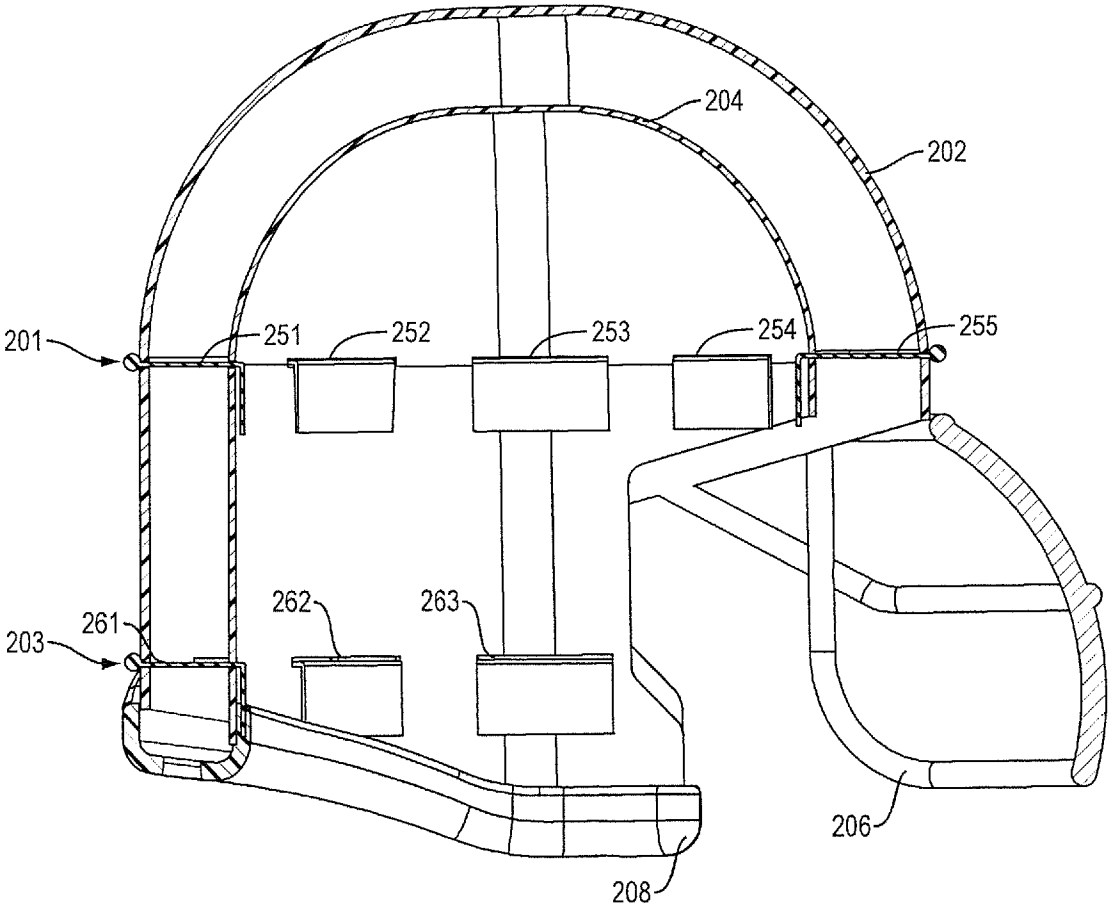

FIGS. 8A-8F show an alternative helmet design, and illustrates features that can be applied to helmets and other impact protection devices according to this disclosure. Helmet 200 comprises inner shell 204 that sits on the head and surrounding spaced outer shell 202. Facemask 206 is mounted to outer shell 202. Energy-absorption subassemblies 201 and 203 in this case each comprise a plurality of separate elastomeric members that are anchored in both shells, such as members 222 and 232, and as shown in FIG. 8F members 251-255 of subassembly 201, and members 261-263 of subassembly 203.

In this non-limiting example, each elastomeric member is a flat sheet that fits through slots in both shells. Each has one enlarged end (e.g., ends 220 and 230) that sits on either the outside of the outer shell or the inside of the inner shell to prevent the member from being pulled through the adjacent slot. The other ends of the elastomeric members are mechanically coupled to the other shell by a suitable mechanical means, such as clamps 224 and 234. Also, additional molded rubber or plastic part 208 (with sufficient compliance such that it does not substantially inhibit relative motion of the shells) is coupled to the lower rims of the two shells. Part 208 can potentially add some additional compliance/energy absorption, but mainly part 208 is used to close the opening between the shells to prevent clothing or other objects from entering.

Figure 9:
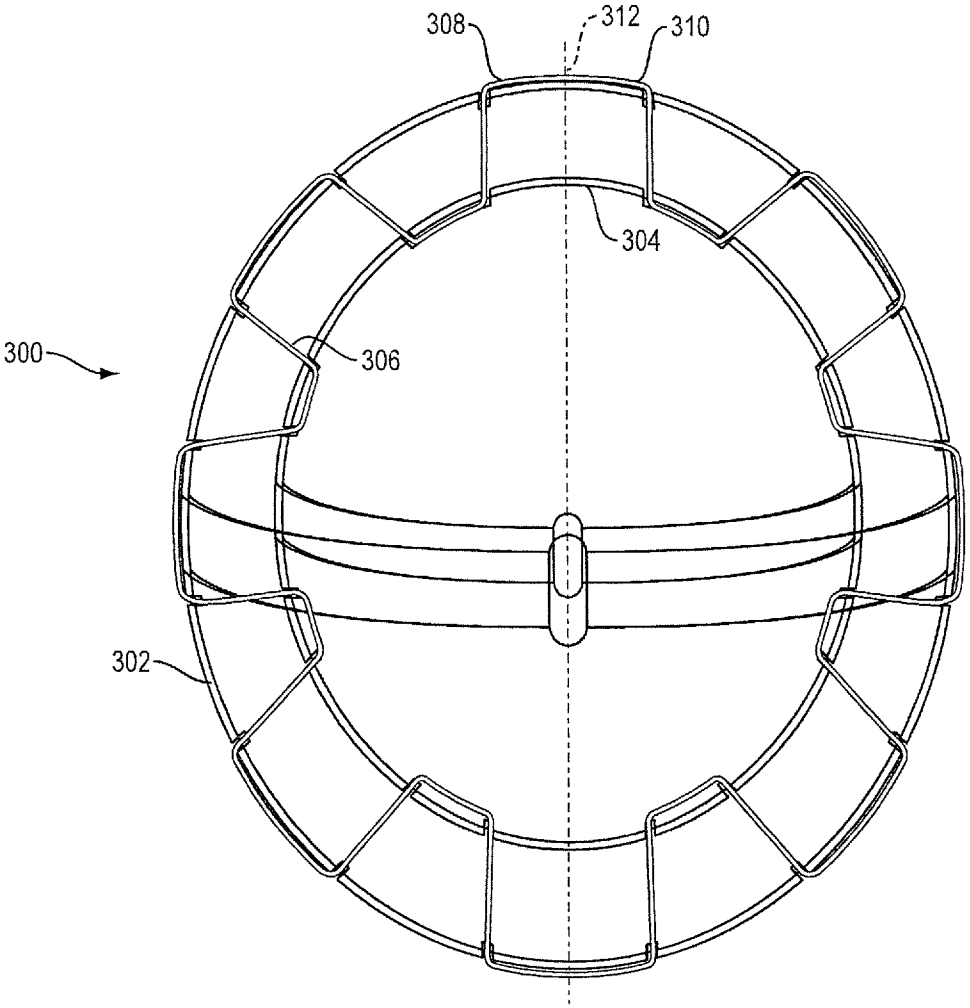
FIG. 9 is a schematic cross-sectional view of a different helmet design.

FIG. 9 is a schematic cross-sectional view of a different helmet design. The helmet 300 includes outer and inner shells 302, 304 and an energy-absorption member 306 disposed there between. As illustrated, the energy-absorption member 306 includes first and second portions 308, 310 disposed on either side of a centerline 312.

As provided above, the personal impact protection device 10 can include an inner shell 14, an outer shell 12, and a set of elastomeric members 16 disposed between a space defined by the inner and outer shells 14, 12. In one arrangement, the elastomeric members and the inner and outer shells of a personal impact protection device can be configured to provide ease of manufacturability, as well as customization of the energy absorption characteristics of the impact protection device.

Figure 10:
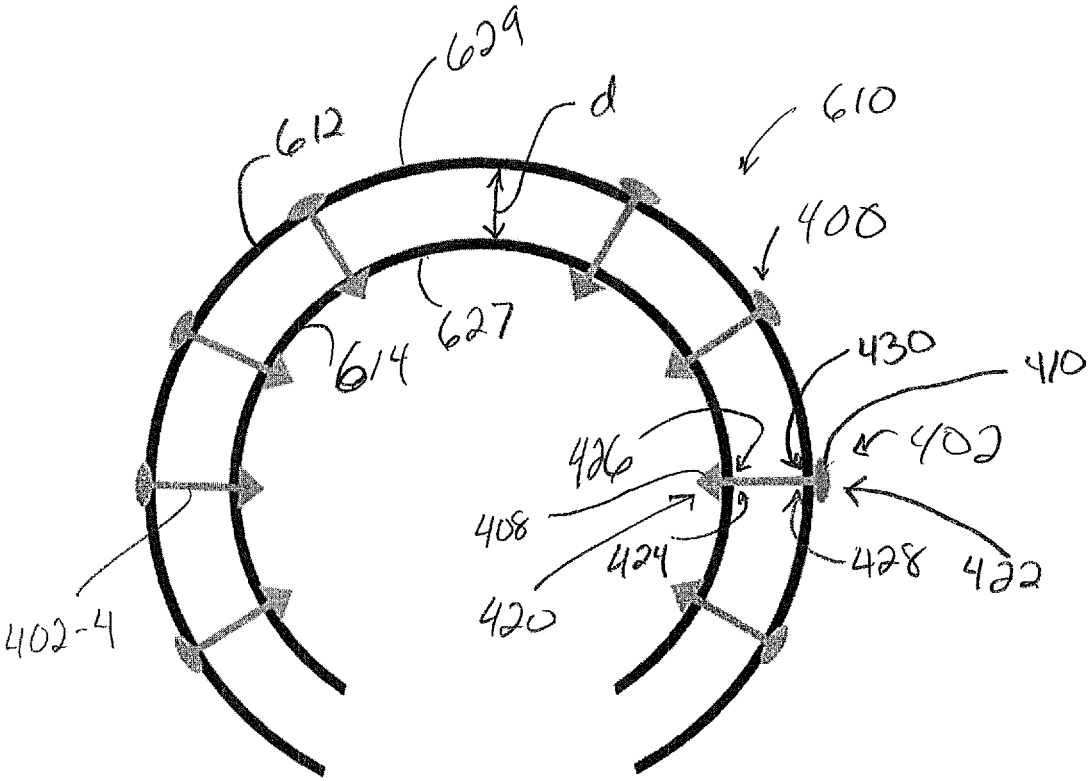
FIG. 10 illustrates a schematic cross-sectional view of an impact protection device, according to one arrangement.

FIG. 10 illustrates an arrangement of a schematic cross-sectional view of an impact protection device 610 having an inner or first shell 614, an outer or second shell 612 and a set of elastomeric members 400 coupled to the first and second shells 614, 612. Each of the shells 614, 612 can be manufactured from a relatively rigid material, such as a plastic material (e.g., polycarbonate).

The first shell 614 is configured to be disposed on a body portion of a user. For example, in the case where the impact protection device 610 is a helmet, the first shell 614 can be disposed on a user's head. In another example, in the case where the impact protection device 610 is a knee protective device, such as illustrated in FIG. 6A, the first shell 614 can be disposed on a user's knee. With these examples, it should be understood that the impact protection device 610 can be configured to function as an energy absorption device for any user body part (e.g., head, knee, shoulder, ankle, torso, etc.).

The second shell 612 spaced at a distance d from the first shell 614. While the distance d can include a variety of lengths, in one arrangement, the distance d between the second shell 612 and the first shell 614 is approximately one inch. With such spacing, the second shell 612 is configured to translate and/or rotate relative to the first shell 614.

The set of elastomeric members 400 include individual elastomeric members 402 spanning the distance d between the first shell 614 and the second shell 612. Each elastomeric member 402 includes a first end 420 and an opposing second end 422 which connect the elastomeric member 402 to the respective first and second shells 614, 612. For example, the first end 420 can include a first end portion 424 disposed within a corresponding opening 426 defined by the first shell 614 and a terminal portion 408 disposed against an inner wall 627 of the first shell 614. Further, the second end 422 can include a second end portion 428 disposed within a corresponding opening 430 defined by the second shell 612 and a terminal portion 410 disposed against an outer wall 629 of the second shell 612.

The set of elastomeric members 400 are configured to absorb a load, such as an impact load, applied to the second shell 612 of the impact protection device 610. For example, each elastomeric member 402 operates mechanically as an extension spring configured to resist a tensile load. As such, and as will be described in detail below, the elastomeric members 402 located opposite to an impact zone on the second shell 612 are configured to stretch as the second shell 612 moves relative to the first shell 614, such as along a direction of a length of the elastomeric member 402. Such stretching can decelerate the second shell 612 relative to the first shell 614 to absorb at least a portion of the impact energy delivered to the second shell 612.

Further, the set of elastomeric members 400 are configured to resist rotational impact loads applied to the second shell 612. For example, as provided above, the elastomeric members 400 space the second shell 612 from the first shell 614 by the distance d. As such, the second shell 612 can rotate relative to the first shell 614 and as such, the elastomeric members 402 located opposite to a rotational impact zone on the second shell 612 can resist such rotational loading. Additionally, in response to rotational impact loads, rotation of the second shell 612 can deflect at least a portion of the rotational impact load away from the impact protection device 610. As such, rotation of the second shell 612 mitigates the absorption of the deflected energy by the impact protection device 610.

Figure 11:
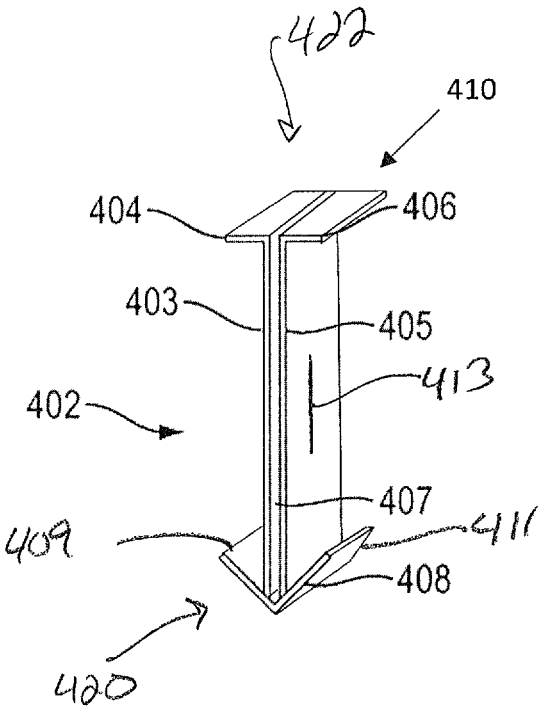
FIG. 11 illustrates an example of an elastomeric member of the impact protection device of FIG. 10, according to one arrangement.

An example arrangement of an elastomeric member 402 is illustrated in FIG. 11. As shown, each elastomeric member 402 can include a first end 420 having a first terminal portion 408, a second end 422 having a second terminal portion 410, and first and second legs 403, 405 disposed between the terminal portion 408 of the first end 420 and the terminal portion 410 of the second end 422.

Figure 12:
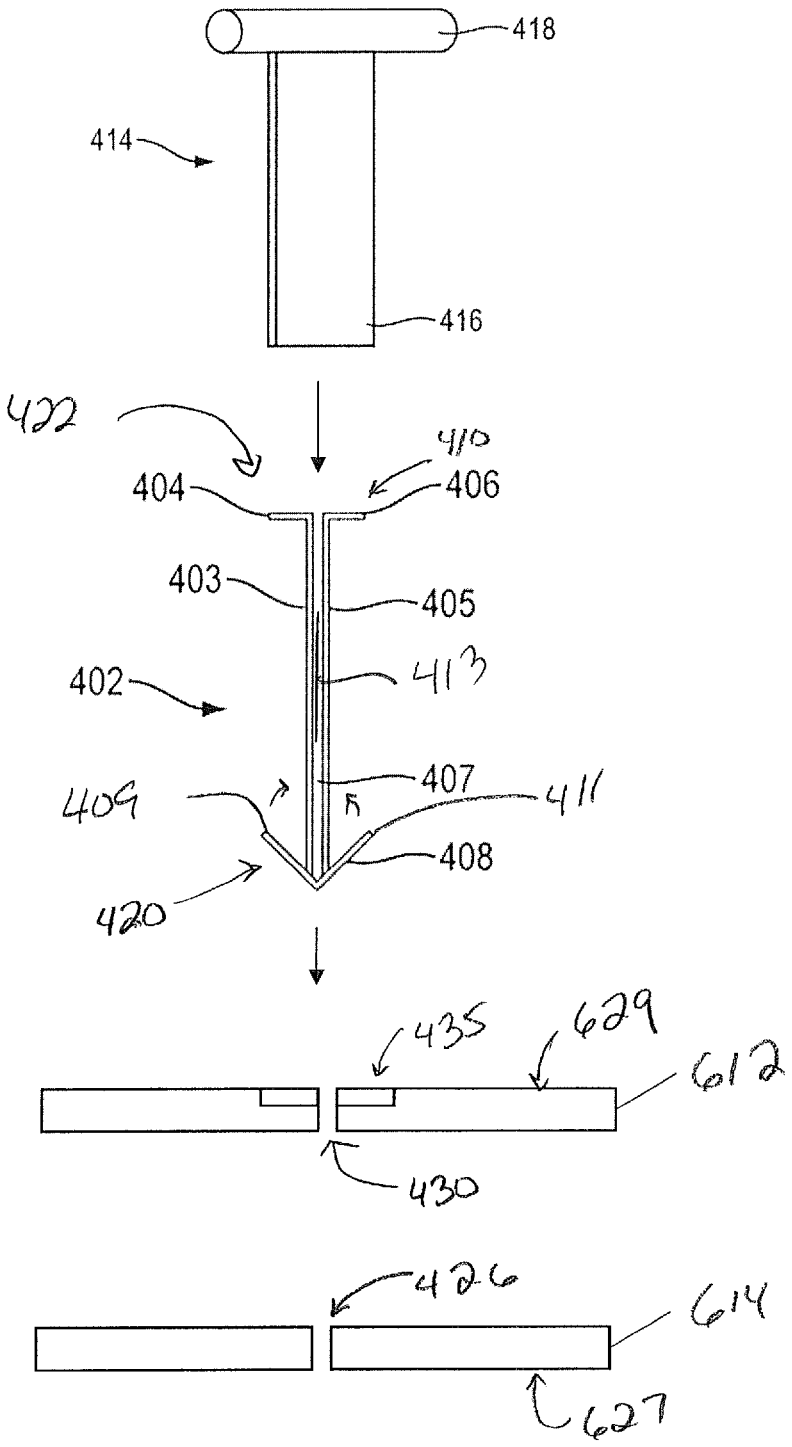
FIG. 12 illustrates an exploded view of an example assembly of the impact protection device of FIG. 10, according to one arrangement.

The first leg 403, the second leg 405, and the terminal portion 408 of the first end 420 can define an opening 407 there between. The opening 407 is configured to receive an insertion tool to facilitate insertion and coupling of the elastomeric member 402 to the shells 614, 612. For example, FIG. 12 illustrates an arrangement of an insertion tool 414 having a blade 416 and handle 418 where the blade 416 is sized and shaped to fit into the opening 407 between legs 403 and 405.

Returning to FIG. 11, the first terminal portion 408 can be configured to facilitate insertion of the elastomeric member 402 into the openings 426, 430 of the corresponding shells 614, 612, as well as to secure the first end 420 to the first shell 614. For example, the first terminal portion 408 includes hinged portions 409, 411 which are configured to rotate relative to a longitudinal axis 413 of the first and second legs 403, 405. As indicated in FIG. 12, as an assembler inserts the elastomeric member 402 into openings 430, 426, the hinged portions 409, 411 are configured to rotate toward the longitudinal axis 413. This allows the manufacturer to advance the elastomeric member 402 through opening 430 and toward opening 426. As the assembler extends the first terminal portion 408 through the opening 426, the hinged portions 409, 411 are configured to toward the longitudinal axis 413 such that the hinged portions 409, 411 contact the inner wall 627 of the first shell 614, as indicated in FIG. 10. Such contact can secure the first end 420 of the elastomeric member 402 to the first shell 614.

Returning to FIG. 11, the second terminal portion 410 can be configured to secure the second end 422 to the second shell 612. For example, the second terminal portion 410 can include terminal elements 404, 406 which can be disposed substantially perpendicular to the longitudinal axis 413 of the first and second legs 403, 405. With reference to FIG. 12, following insertion of the elastomeric member 402 into the openings 426, 430, of the first and second shells 614, 612, the terminal elements 404, 406 are disposed against the outer wall 629 of the second shell 612 and within a recess 435 defined by the second shell 612 and disposed in proximity to the opening 430. Such contact can secure the second end 422 of the elastomeric member 402 to the second shell 612.

Figure 13:
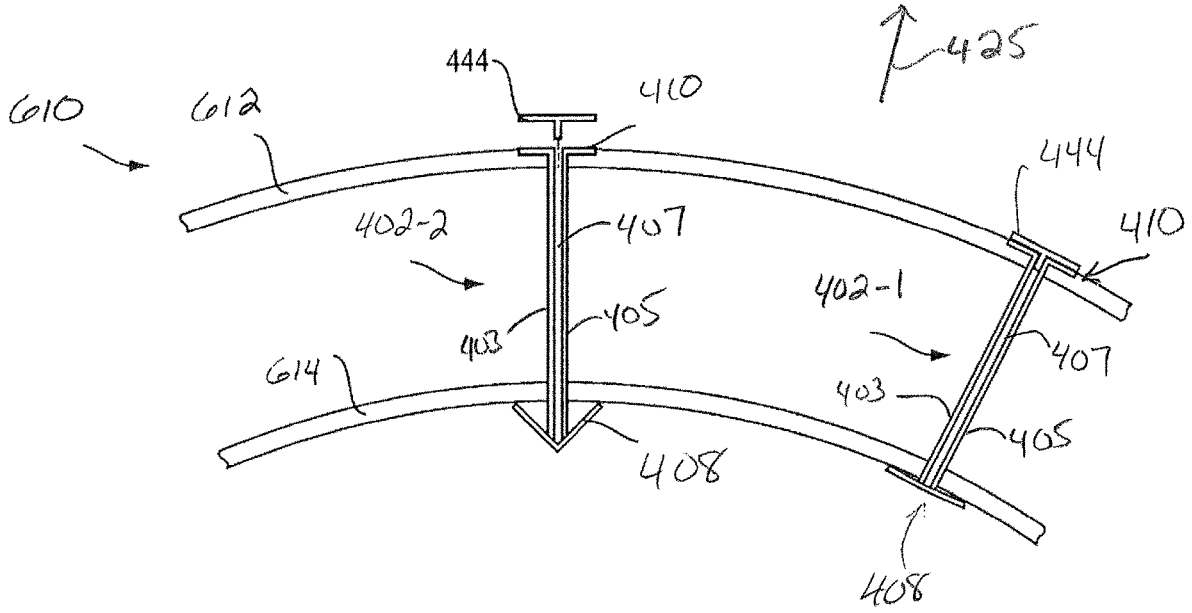
FIG. 13 illustrates an example configuration of the elastomeric members of the impact protection device of FIG. 10, according to one arrangement.

With reference to FIG. 13, the second terminal portion 410 can further include a securing mechanism or cap 444 configured to further couple the second end 422 of the elastomeric member 402 to the second shell 612. During assembly, an assembler can dispose the terminal portion 410 between the recess 435 defined by the outer wall 629 of the second shell 612 and the securing mechanism 444. In one arrangement, a portion of the securing mechanism 444 can extend into the opening 407 to compress a portion of the first and second legs 403, 405 against the inner wall of the opening 430 to further couple the second end 422 of the elastomeric member 402 to the second shell 612 and to smooth the outside of impact protection device 610.

In one arrangement, the set of elastomeric members 400 of an impact protection device 610 can include elastomeric members 402 having varying geometries and mechanical properties. By including different types of elastomeric members 402, the impact protection device 610 can be customized to function in a particular scenario.

In one arrangement, certain elastomeric members 402 of the set of elastomeric members 400 can have different relative lengths, such as illustrated in FIG. 13. For example, the impact protection device 610 can include a first elastomeric member 402-1 and a second elastomeric member 402-2 where the second elastomeric member 402-2 is relatively longer than the first elastomeric member 402-1. With such a configuration, in the case where the impact protection device 610 is disposed in an at-rest, non-impacted position, the second elastomeric member 402-2 is slack between the first and second shells 614, 612. Following an impact of the impact protection device 610 at a location opposite to the location of elastomeric members 402-1, 402-2, the second shell 612 can travel along direction 425 relative to the first shell 614. As a result, the first elastomeric member 402-1 can stretch along direction 425 to absorb the impact energy. In the case of a relatively high energy impact, if the second shell 612 is displaced sufficiently from the first shell 614, the second elastomeric member 402-1 can be extended from the slack position to stretch between the first and second shells 614, 612 to absorb additional energy associated with the impact. Accordingly, the use of multiple elastomeric members 402 of different lengths can provide a cumulative energy-absorption affect to the impact protection device 610.

Figure 14:
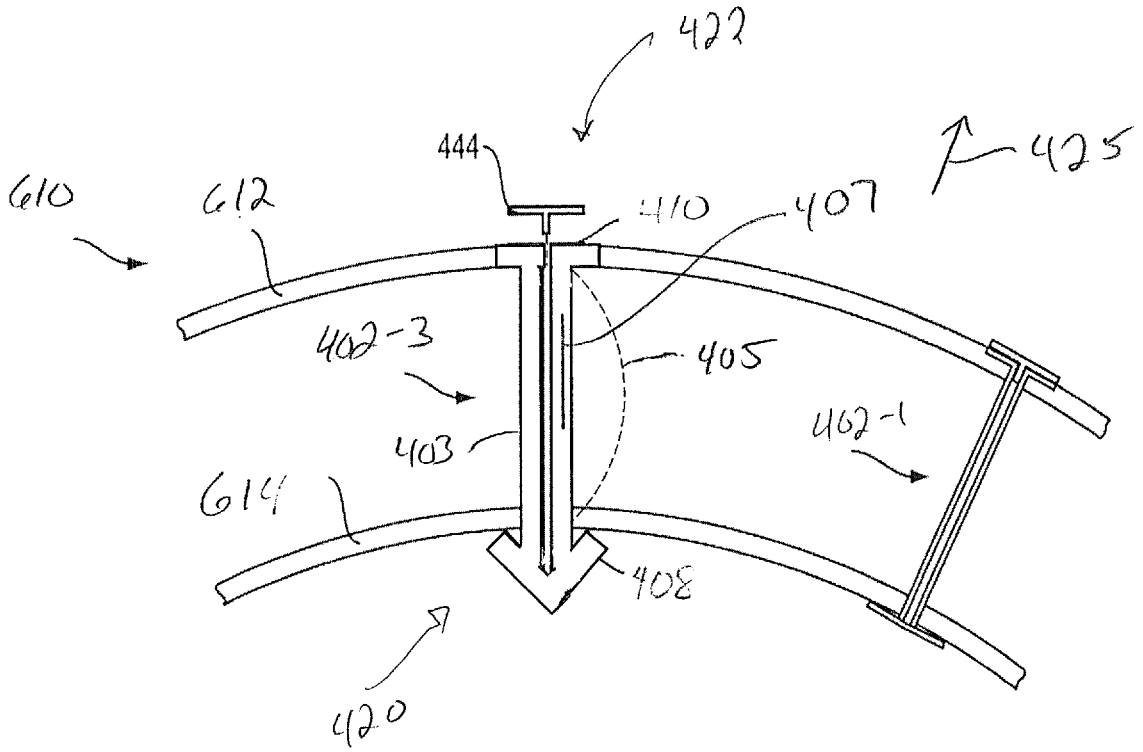
FIG. 14 illustrates an example configuration of the elastomeric members of the impact protection device of FIG. 10, according to one arrangement.

In one arrangement, certain elastomeric members 402 of the set of elastomeric members 400 can have different relative strengths or spring constants. For example, with reference to FIG. 14, the impact protection device 610 includes a first elastomeric member 402-1 and a second elastomeric member 402-3 where the second elastomeric member 402-3 is thicker than the first elastomeric member 402-1 and, as such, a higher spring constant (i.e., higher resistivity to stretch) relative to the first elastomeric member 402-1. With such a configuration, following an impact of the impact protection device 610 at a location opposite to the location of elastomeric members 402-1, 402-3, the second shell 612 can travel along direction 425 relative to the first shell 614. As a result, the first elastomeric member 402-lean stretch along direction 425 to absorb impact energy. In the case of a relatively high energy impact, if the second shell 612 is displaced sufficiently from the first shell 614, the second elastomeric member 402-3 can be extended to absorb additional energy associated with the impact. The use of multiple elastomeric members 402 of different strengths can provide a cumulative energy-absorption affect to the impact protection device 610.

In one arrangement, the thickness of the elastomeric members 402 can vary between the terminal portion 408 of the first end 420 and the terminal portion 410 of the second end 422. For example, with reference to the second elastomeric member 402-3, the second leg 405 can include a variable wall thickness (e.g., a D-shaped wall thickness) extending along the longitudinal axis 407. With such a variable wall thickness, the spring constant of the second elastomeric member 402-3 can vary in response to the increase in the displacement distance d between the second and first shells 612, 614 in response to an impact load.

FIG. 12 indicates an example assembly process for an impact protection device 610. During assembly, a manufacturer disposes the blade 416 of the insertion tool 414 into the opening 407 of an elastomeric member 402 to provide a degree of rigidity to the member 402. The manufacturer advances the elastomeric member 402 through aligned openings 430, 426 in the second and first shells 612, 614 via the insertion tool 414. For example, the manufacturer applies force to the handle 418 to force the second terminal portion 408 through the opening 430 in the second shell and through the opening 426 of the first shell 614. Once the second terminal portion 410 is disposed against the outer wall 629 of the second shell 612 and the first terminal portion 408 is disposed against the inner wall 627 of the first shell 612, the manufacturer has anchored the elastomeric member 402 to both shells 612, 614. The manufacturer can then insert the securing mechanism 444 into the recess 435 to further couple the elastomeric member 402 to the second shell 612 and to smooth the outside of impact protection device 610.

Following assembly, at least a portion of the elastomeric members 402 of the set 400 are disposed under tension and hold the second shell 612 in position relative to the first shell 614. This insures that following impact, the second shell 612 will recover to its original position relative to the first shell 614 for a subsequent impact.

Figure 15:
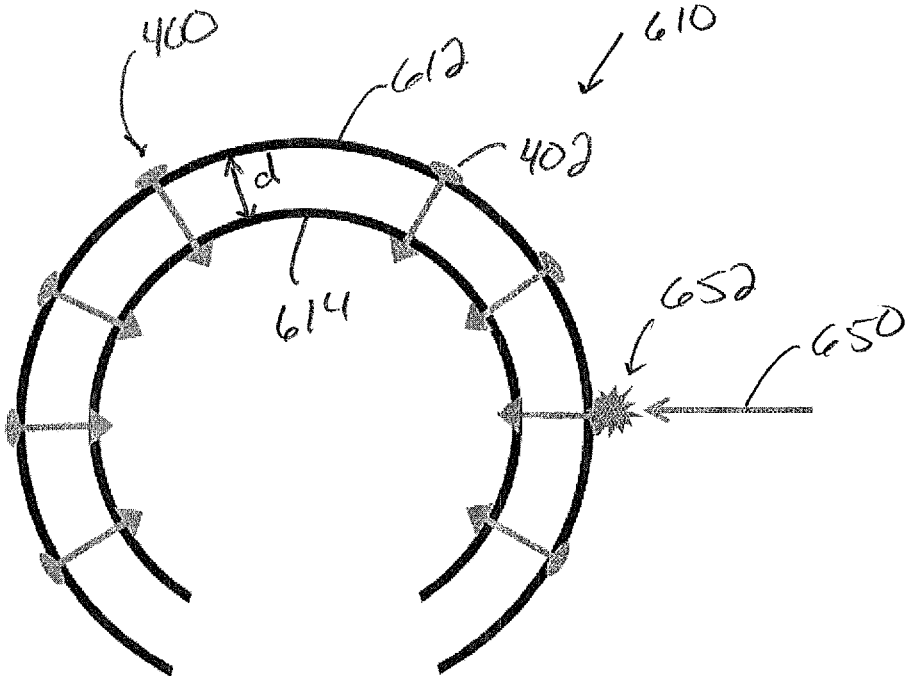
FIG. 15 illustrates a schematic cross-sectional view of an impact protection device at a first impact load state, according to one arrangement.
Figure 16:
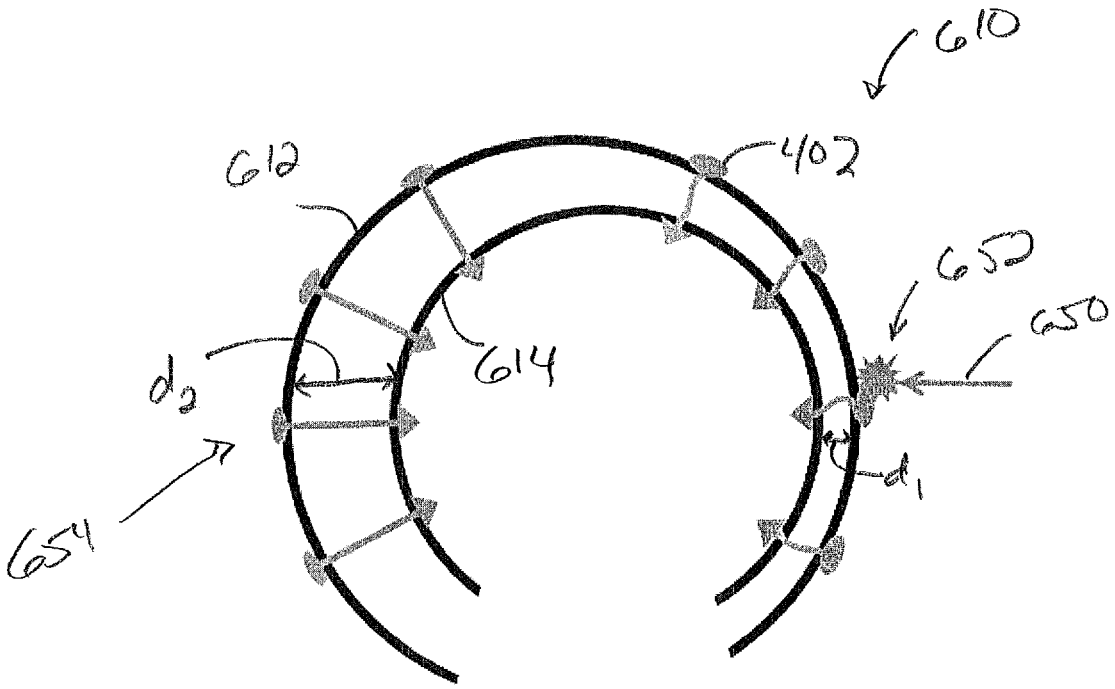
FIG. 16 illustrates a schematic cross-sectional view of the impact protection device of FIG. 15 at a second impact load state, according to one arrangement.
Figure 17:
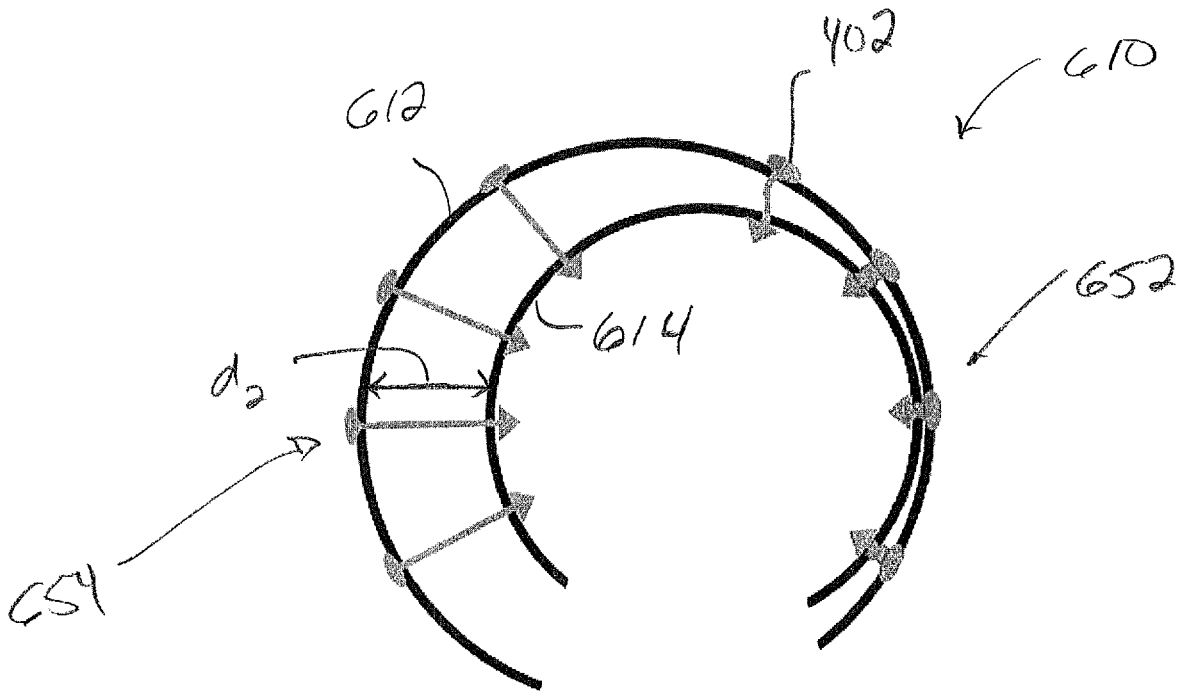
FIG. 17 illustrates a schematic cross-sectional view of the impact protection device of FIG. 15 at a third impact load state, according to one arrangement.

The impact protection device 610 can be worn by a user on a user's body portion (e.g., head, knee, shoulder, etc.) and utilized to absorb the energy of an impact. During operation, the set of elastomeric members 400 are configured to stretch between the first shell 614 and the second shell 612 in response to a translation of the second shell 612 relative to the first shell 614 and at a location that is substantially opposite to an impact receiving location of the second shell 612. For example, as the elastomeric members 402 opposite to the impact location stretch, they absorb momentum of the second shell 612 and the energy of the impact, and thus lowering or eliminating the force of the impact felt by the person wearing the device 610. FIGS. 15-17 illustrate an example of the impact protection device 610 operating when receiving an impact load and indicate that an impact load applied to the second shell 612 passes through expanding, but resistive, elastomeric members 402 before the first shell 614 reaches full velocity caused by the impact load.

As illustrated in FIG. 15, in a non-impacted state, the impact protection device 610 includes a set of elastomeric members 400 having at least a subset of elastomeric members 402 which are disposed under tension between the first and second shells 614, 612. The elastomeric members 402 space the second shell 612 at a distance d from the first shell 614. At the instant of the application of an impact load 650 at an impact location 652, the outer shell 612 begins to move (e.g., translate and/or rotate) relative to the first shell 614. It is noted that the movement of the second shell 612 mitigates motion of the first shell 614 and user's head from the impact load 650.

As illustrated in FIG. 16, as the application of the impact load 650 at the impact location 652 continues, the legs 403, 405 of the elastomeric members 402 in proximity to the impact location 652 fold or collapse on each other while the legs 403, 405 of the elastomeric members 402 at the location 654 opposite to the impact location 652 stretch resistively to decelerate the second shell 612 relative to the first shell 614 and to accelerate the inner shell 614 and the user's head. Further, the distance $d_1$ between the shells 612, 614 in proximity to the impact location 652 decreases while the distance $d_2$ between the shells 612, 614 at the location 654 increases.

As illustrated in FIG. 17, as a result of the application of the impact load 650 at the impact location 652, the outer shell 612 continues to move relative to the first shell 614 until the second shell 612 contacts the first shell 614 at the impact location 652. At this point, the elastomeric members 402 at the opposite location 652 have decelerated the second shell 612 relative to the first shell 614 and the user's head. Further acceleration of the first shell 614 and the user's head can continue if the impact load 650 is still in contact with the outer shell 612. However, in this case, the elastomeric members 402 opposite the impact location 652 have reduced the velocity differential between the second shell 612 and the first shell 614 and the user's head which, in turn, can mitigate further acceleration of the user's head. For example, movement of the user's head be mitigated until the elastomeric members have overcome the inertia of the user's head and the first shell 614.

With the positioning of the impact protection device 610 shown in FIG. 17 (e.g., maximal stretching of the elastomeric members 402 at the location 654), the velocity of the user's head may equal the velocity of the impact load 650. However, the configuration of the impact protection device 610 with the elastomeric members 402 can delay that occurrence. Such an increase in time for the user's head to reach full velocity can reduce the acceleration of the user's head in proportion to that time.

With the configuration of the impact protection device 610 described above, the elastomeric members 402 allow a manufacturer to assemble the impact protection device 610 in a relatively non-labor intensive manner with a relatively low manufacturing cost. For example, as provided above, the insertion tool 414 provides a manufacturer with the ability to affix elastomeric members 402 to the shells 612, 614 and to secure the shells 612, 614 together. As such, the elastomeric members 402 can function as both the shell coupling mechanism and the deceleration mechanism within the impact protection device 610, thereby reducing the number of parts needed to assemble the shells 614, 612 to manufacture the impact protection device 610, as well as reducing the assembly time needed.

Further, the configuration of the impact protection device 610 facilitates repair by an assembler or manufacturer. For example, with reference to FIG. 10, assume the case where elastomeric member 402-4 becomes damaged. By reversing the insertion process described above, a manufacturer can remove the damaged elastomeric member 402-4 from the shells 612, 614 and can replace the damaged member with a substitute elastomeric member 402. As such, the manufacturer can remove and replaced damaged elastomeric members without requiring that the entire impact protection device 610 be disassembled.

Additionally, the configuration of the impact protection device 610 provides the manufacturer with the ability to customize an impact response of the impact protection device 610. In one arrangement, following an assembly of an impact protection device 610, a manufacturer can replace any number of elastomeric members 302 to either increase or decrease the resistivity of the device 610 for a particular application. For example, to configure the impact protection device 610 for cases where lower impact loads are expected, such as with non-professional users or relatively younger users, the manufacturer can replace particular elastomeric members 402 in the device 610 with elastomeric members 402 having a relatively lower load absorption threshold or spring constant. Alternately, to configure the impact protection device 610 for cases where higher impact loads are expected, such as with professional users, the manufacturer can replace particular elastomeric members 402 in the device 610 with elastomeric members 402 having a relatively higher load absorption threshold or spring constant. As such, the manufacturer can customize the impact protection device 610, depending upon its use.

As provided above, the configuration of the elastomeric members 402 provides a manufacturer with the ability to customize the impact response of the impact protection device 610. In one arrangement, the elastomeric members 402 can form part of an energy absorption subassembly having a particular, preconfigured impact response. For example, the energy absorption subassembly can include elastomeric members 402 having a relatively low load absorption threshold or spring constant for lower load impacts while a second energy absorption subassembly can include elastomeric members 402 having a relatively high load absorption threshold or spring constant for higher load impacts. As will be described below, a manufacturer can couple the energy absorption subassembly to the first and second shells 614, 612 to form an impact protection device 710.

Figure 18:
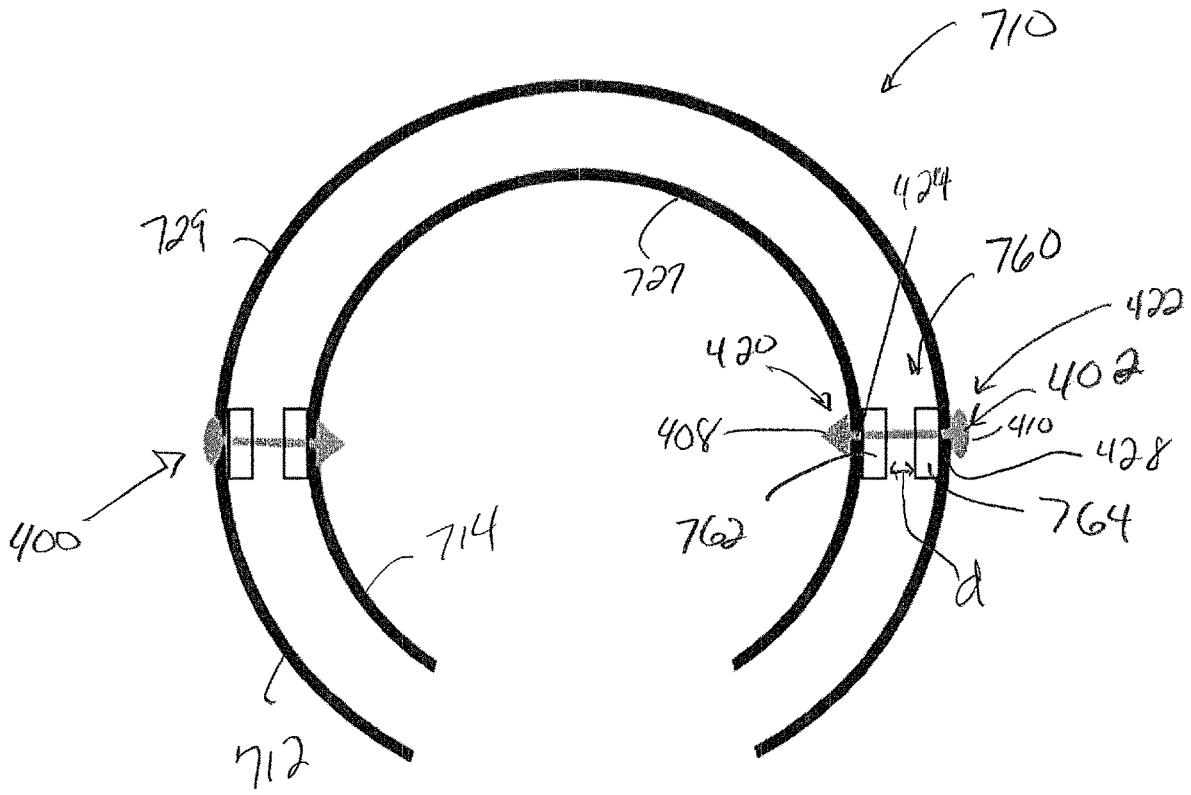
FIG. 18 illustrates a schematic cross-sectional view of an impact protection device having an energy absorption subassembly, according to one arrangement.
Figure 19:
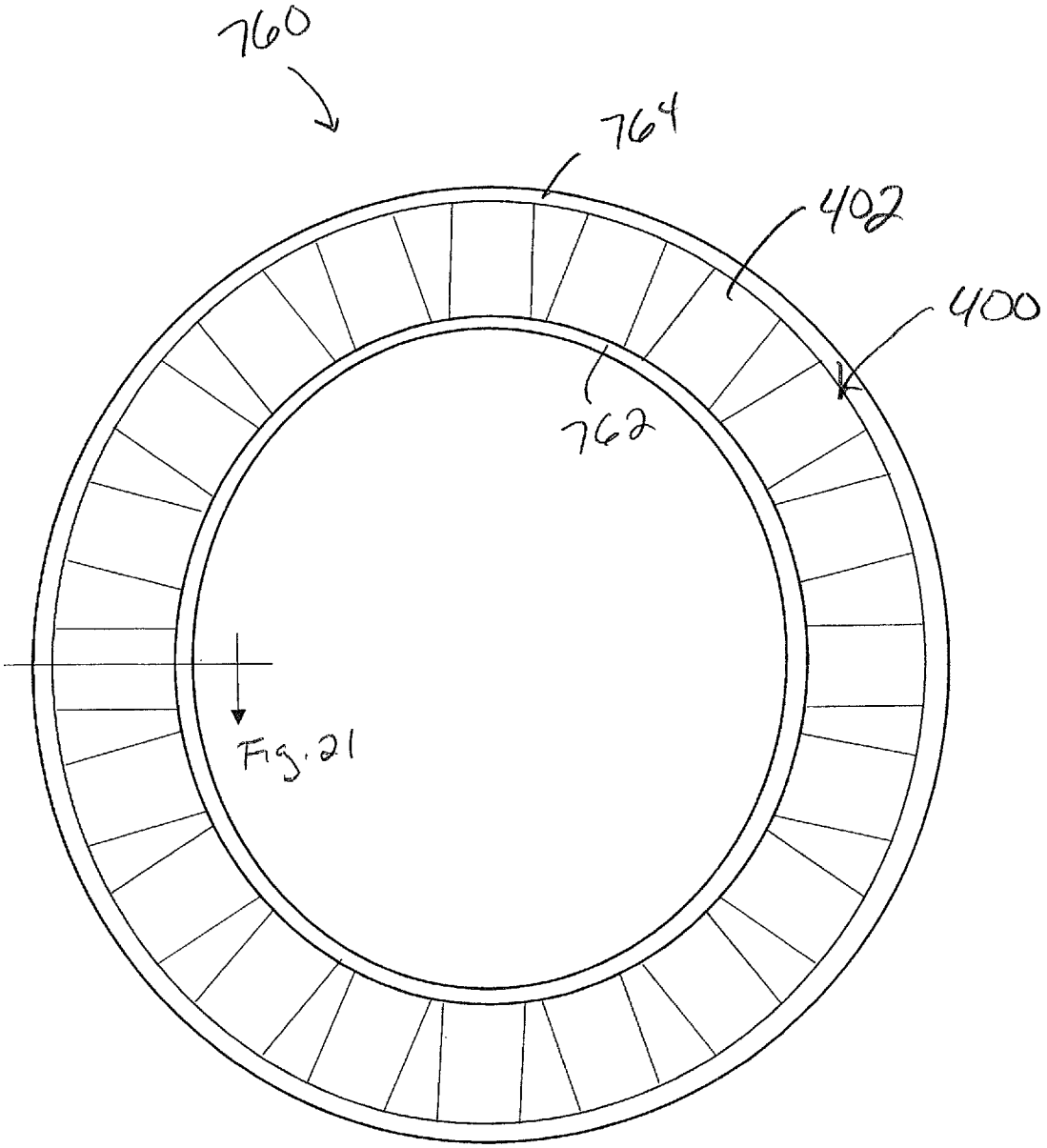
FIG. 19 illustrates a top view of the energy absorption subassembly of FIG. 18, according to one arrangement.

FIG. 18 illustrates an impact protection device 710 having at least one energy absorption subassembly 760 disposed between a first shell 714 and a second shell 716, according to one arrangement. The energy absorption subassembly 760 includes a first component 762 and a second component 764 spaced at a distance d from the first component 762. With additional reference to FIG. 19, the first component 762 of the energy absorption subassembly 760 can be configured as a first ring and the second component 764 of the energy absorption subassembly 760 can be configured as a second ring spaced concentrically from the first component 762.

The energy absorption subassembly 760 also includes a set of elastomeric members 400 spanning the distance d between the first component 762 and the second component 764. This spacing defines a deceleration zone of the within the energy absorption subassembly 760.

Each elastomeric component 402 can be configured with a particular thickness and width and/or material in order to provide the energy absorption subassembly 760 with a particular, preconfigured impact response. Further, each elastomeric component 402 can be located at particular locations between the first component 762 and the second component 764 and spaced in a desired manner to accomplish a particular amount of energy-absorption at one or more desired locations of the subassembly 760. For example, relatively stronger elastomeric components 402 can be disposed between the first and second components 762, 764 with some slack such that they begin to stretch only close to the endpoint of travel of the second component 764. With such a configuration, the energy absorption subassembly 760 can provide a relatively high load absorption, which is useful for heavy (i.e., relatively high load) impacts.

Figure 20:
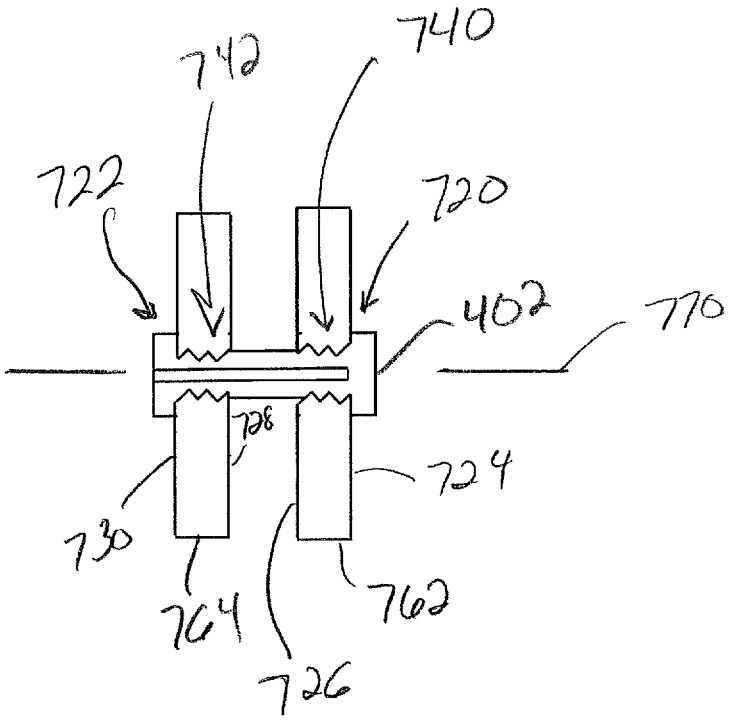
FIG. 20 illustrates a side view of the energy absorption subassembly of FIG. 18, according to one arrangement.

Each elastomeric component 402 of the set 400 can be coupled to the first and second components 762, 764. For example, with reference to FIG. 18, each elastomeric component 402 includes a first end 420 and an opposing second end 422, the first end 420 being coupled to the first component 762 and the second end 422 coupled to the second component 764. While the elastomeric components 402 can be coupled to the first and second components 762, 764 in a variety of ways, in one arrangement and with reference to FIG. 20, the first and second components 762, 764 each include a clamping mechanism configured to interact with a corresponding elastomeric component 402 to secure the component 402 thereto.

For example, as illustrated, the first component 762 defines a first opening 720 of a first set of openings extending between an inner wall 724 and an outer wall 726 of the component 762 and the second component 764 defines a second opening 722 of a second set of openings extending between an inner wall 728 and an outer wall 730. The first component 762 includes a first clamping mechanism 740 disposed within the opening 720 and the second component 764 includes a second clamping mechanism 742 disposed within the opening 722. The clamping mechanisms 740, 742 are configured to secure corresponding first and second end portions of the elastomeric member 402 to the components 762, 764.

For example, the clamping mechanisms 740, 742 can include corrugations within the corresponding openings 720, 722 where the width of the corrugated opening is less than a width of the elastomeric member 402. During assembly, a manufacturer can apply a tension to the elastomeric member 402 along longitudinal axis to reduce the effective thickness of the member 402 in order to insert the member 402 into the openings 720, 722. Once disposed within the openings 720, 722, the manufacturer can release the tension along the longitudinal axis to allow the elastomeric member 402 to expand against the clamping mechanisms 780, 782, thereby securing the elastomeric member 402 to the first and second components 762, 764 and disposing the elastomeric member 402 under tension between the first and second components 762, 764.

Returning to FIG. 18, the first and second ends 420, 422 of the elastomeric members 402 are also coupled to the first and second shells 714, 712 of the impact protection device 710. For example, the first end 420 can include a first end portion 424 disposed within a corresponding opening 726 defined by the first shell 714 and a terminal portion 408 disposed against an inner wall 727 of the first shell 714. Further, the second end 422 can include a second end portion 428 disposed within a corresponding opening 730 defined by the second shell 712 and a terminal portion 410 disposed against an outer wall 729 of the second shell 712.

Figure 21:
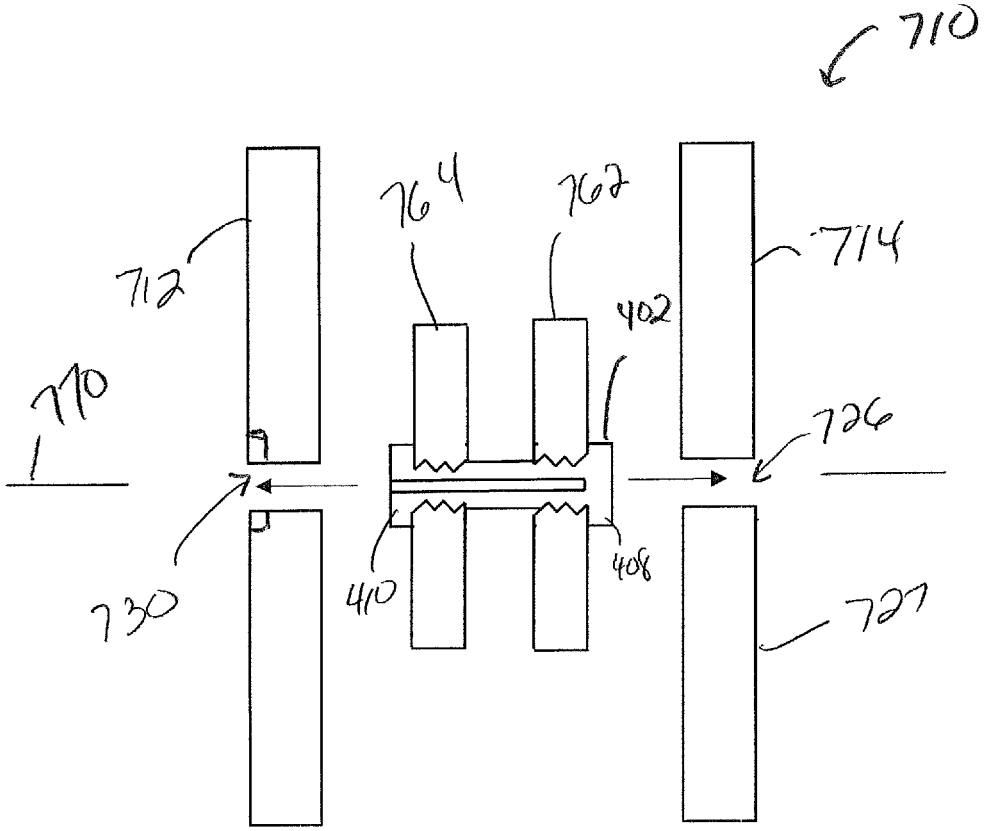
FIG. 21 illustrates a first assembly state of the energy absorption subassembly and shells of an impact protection device, according to one arrangement.
Figure 22:
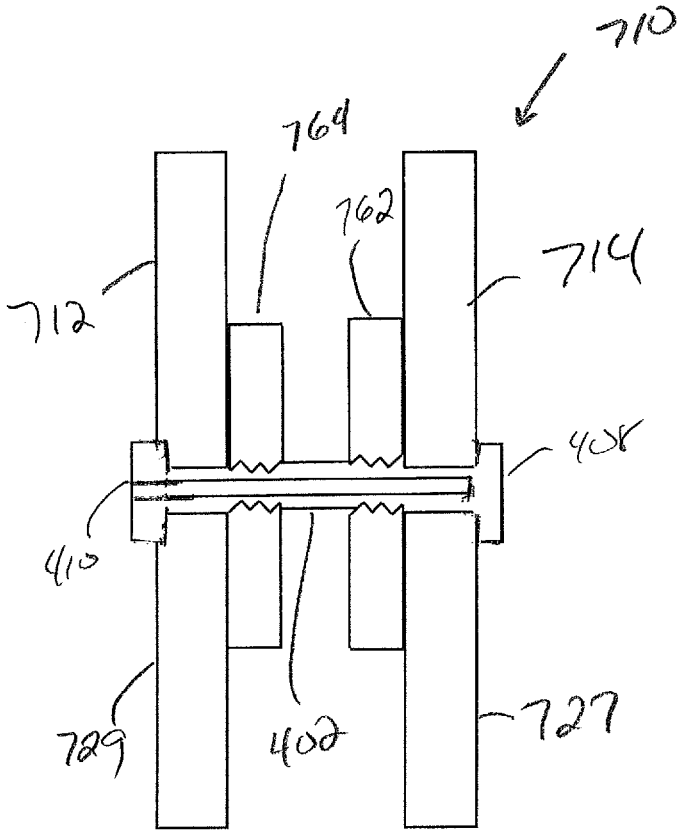
FIG. 22 illustrates a second assembly state of the energy absorption subassembly and shells of an impact protection device, according to one arrangement.

With reference to FIG. 21, during an assembly process, a manufacturer can grasp and apply a tensile load to the terminal portions 408, 401 of the elastomeric member 402 along longitudinal axis 770 and through corresponding openings 726, 730. With the elastomeric member 402 secured to the first and second components 762, 764, such a process can stretch the elastomeric member relative to the first and second components 762, 764. With reference to FIG. 22, with the terminal portions 408, 401 extending through the openings 726 and past the first and second components 762, 764, the manufacturer can release the tensile load, thereby causing the terminal portions 408, 401 to rest against the inner wall 727 of the first shell 714 and the outer wall 729 of the second shell 712, respectively. As such, the elastomeric member 402 can couple the first component 762 to an outer location of the first shell 714 and the second component 764 to an inner location of the second shell 712.

With such a configuration, the energy absorption subassembly 760 can establish the gap or distance between the first and second shells 714, 712. Accordingly, during operation, an impact to one side of the impact protection device 710 causes the second component 764 to move relative to the first component 762, while the first component 762 remains substantially stationary relative to a user's body part. Movement of the second component 764 causes the spacing between the elastomeric members 402 to change: the elastomeric members 402 in proximity to the location of impact can collapse and elastomeric members 402 opposite to the impact location can stretch resistively.

Figure 23:
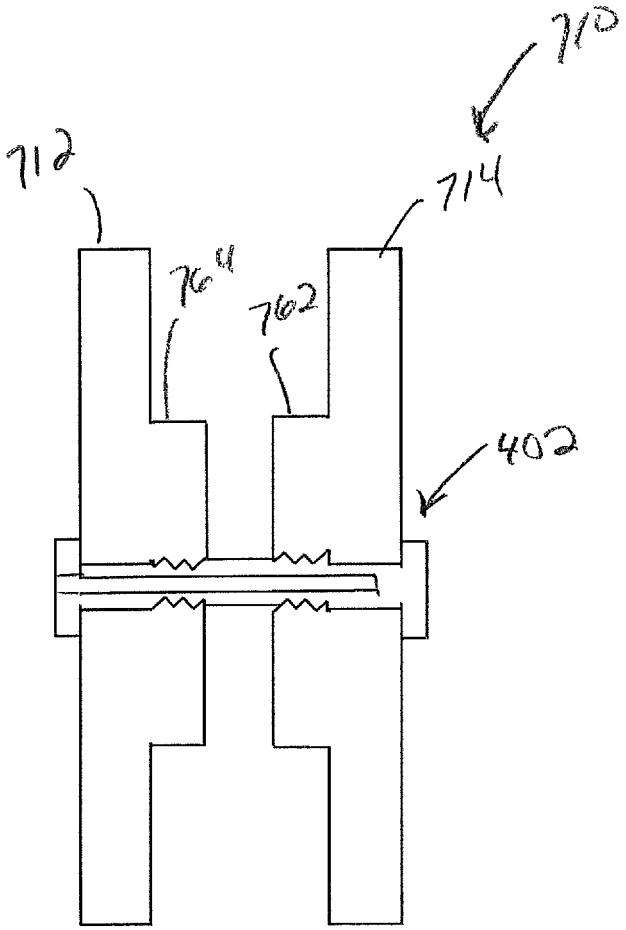
FIG. 23 illustrates a side sectional view of an impact protection device having an energy absorption subassembly, according to one arrangement.

As described above, the elastomeric members 402 can form part of an energy absorption subassembly 760 having a first component 762 and a second component 764 spaced at a distance d from the first component 762 where the first and second components 762, 764 are coupled to the first and second shells 614, 612, respectively. Such description is by way of example only. In one arrangement, the first and second component 762, 764 are integrally formed with the first and second shells 614, 612, as indicated in FIG. 23. With such an arrangement, the first and second components 762, 764 are configured to provide additional structural support to the respective first and second shells 614, 612 at the locations where the elastomeric members 402 attach to the shells 614, 612. Additionally, installation and removal of the elastomeric members 402 can be performed using the installation tool 414 illustrated in FIG. 12.

Figure 24:
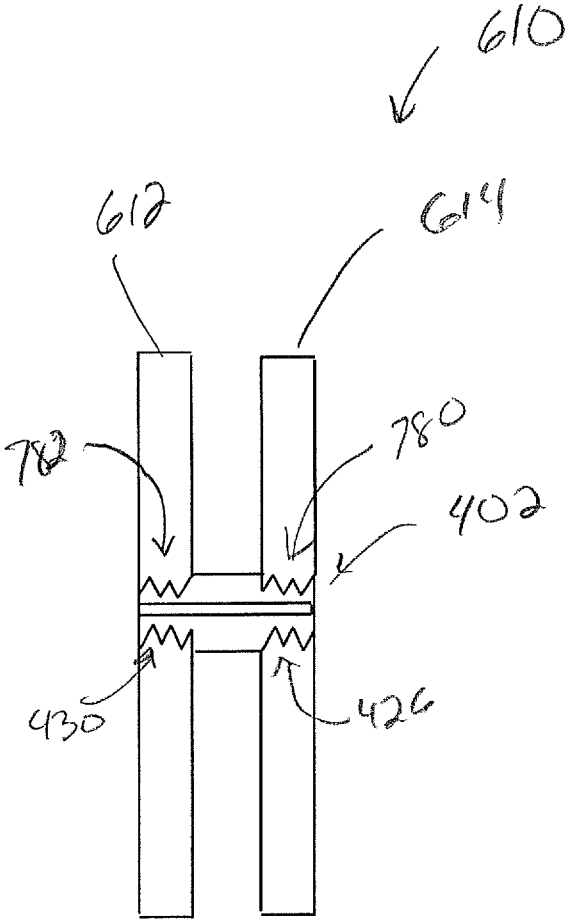
FIG. 24 illustrates a side sectional view of an impact protection device where the first and second shells include a clamping mechanism, according to one arrangement.

As described above, the elastomeric members 402 include a first terminal portion 411 configured to secure a first end 420 to the first shell 614 and a second terminal portion 410 configured to secure the second end 422 to the second shell 612. Such description is by way of example only. In one arrangement, as illustrated in FIG. 24, the first and second shells 614, 612 include respective first and second clamping mechanisms 780, 782 disposed within corresponding openings 426, 430. The clamping mechanisms 780, 782 are configured to secure corresponding first and second end portions of the elastomeric member 402 to the components shells 614, 612. For example, the clamping mechanisms 780, 782 can include corrugations within the corresponding openings 426, 430 where the width of the corrugated opening is less than a width of the elastomeric member 402.

During assembly, a manufacturer can apply a tension to the elastomeric member 402 along longitudinal axis to reduce the effective thickness of the member 402 in order to insert the member 402 into the openings 426, 430. Once disposed within the openings 720, 722, the manufacturer can release the tension along the longitudinal axis to allow the elastomeric member 402 to expand against the clamping mechanisms 780, 782, thereby securing the elastomeric member 402 to the first and second shells 614, 612.

Figure 25:
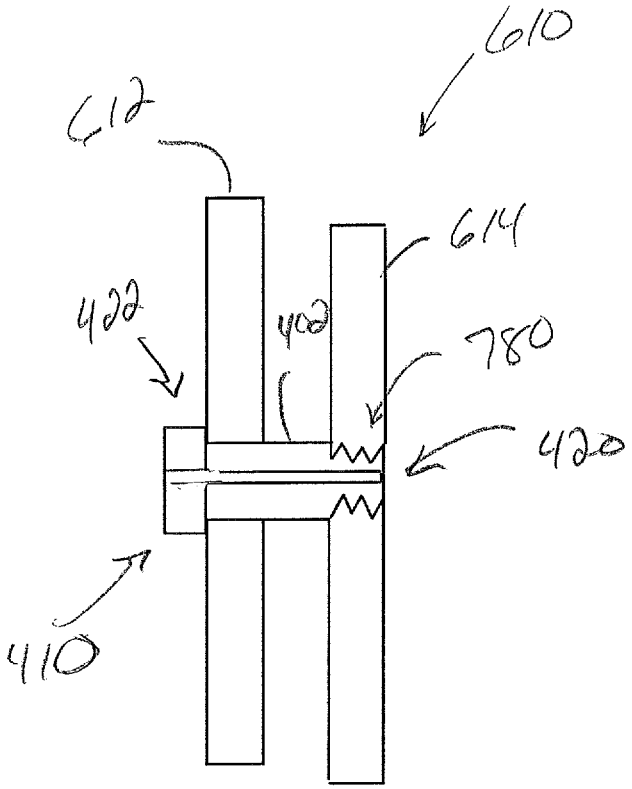
FIG. 25 illustrates a side sectional view of an impact protection device, according to one arrangement.

In one arrangement, the elastomeric member 402 can be secured to the shells 614, 612 using a combination of the terminal portions and the clamping mechanisms, as described above. For example, FIG. 25 illustrates an arrangement of an elastomeric member 402 having a terminal portion 410 at a second end 422 secured to the second shell 612 and having a first end 420 secured to the first shell 614 via a clamping mechanism 780.

Figure 26:
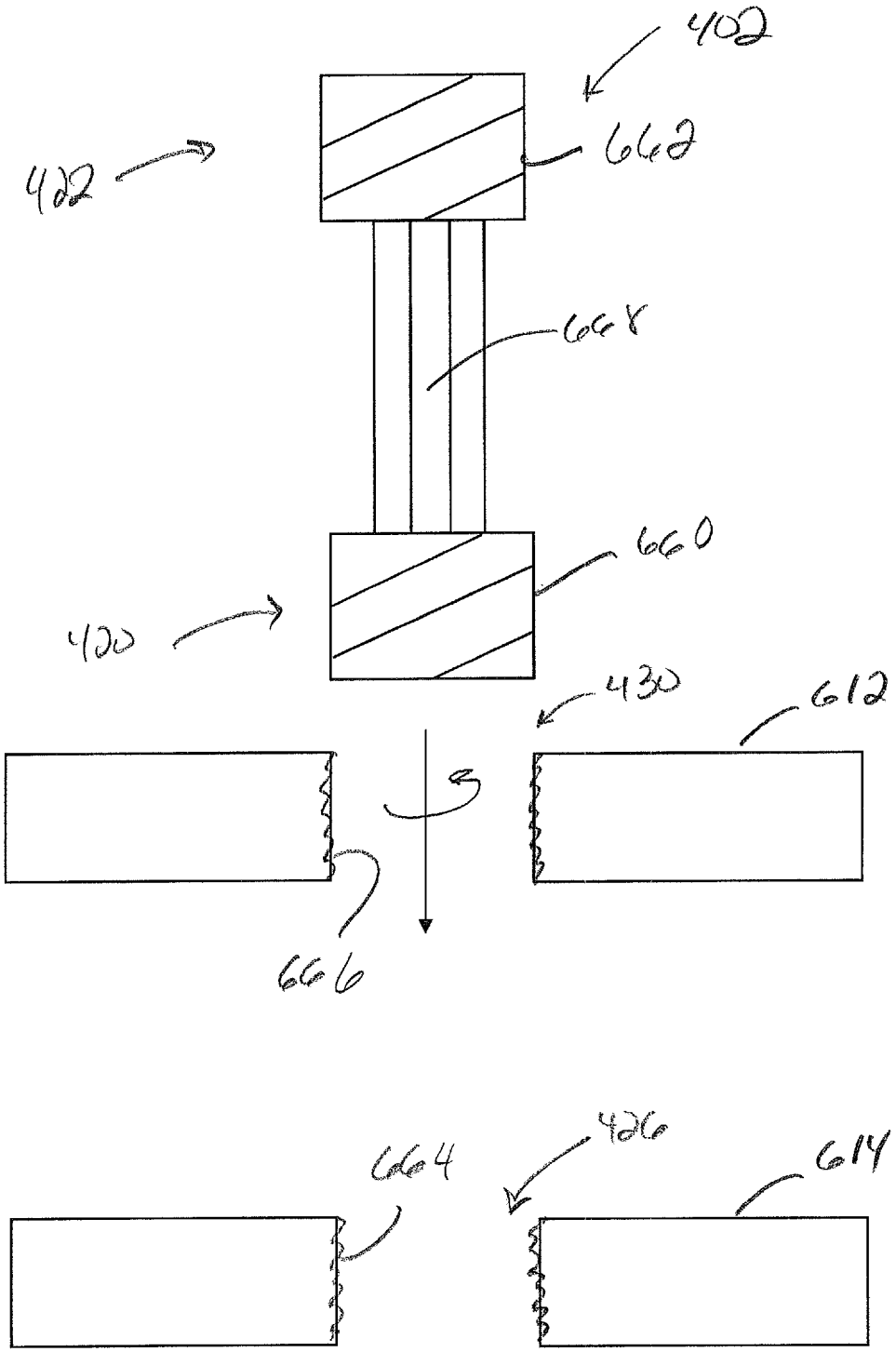
FIG. 26 illustrates an exploded view of an impact protection device having a screw-shaped elastomeric member, according to one arrangement.

As indicated above, the elastomeric members 402 can be configured with a generally rectangular geometry having a first terminal portion 408, a second terminal portion 410, and first and second legs 403, 405 disposed between the terminal portions 408, 410. Such indication was by way of example only. In one arrangement, as indicated in FIG. 26, one or more elastomeric members 402 can include a screw geometry and can be configured both to secure the first and second shells 614, 612 together and to resist tensional loading.

For example, the elastomeric member 402 can define a first set of threads 660 disposed at a first end 420 and a second set of threads 662 at the second end 422. The pitch and spacing of the threads 660, 662 can correspond to the tapped threads 664, 666 defined by the corresponding openings 426, 430 of the first and second shells 614, 612. In one arrangement, the material forming the elastomeric member 402 has a relatively high rotational stiffness, thereby allowing the manufacturer to rotate the elastomeric member 402 and advance the member 402 into the first and second shells 614, 612. In one arrangement, the elastomeric member includes a tool insertion portion, such as opening 668 disposed between the first and second ends 420, 422, which allows a manufacturer to utilize an insertion tool to provide a level of rotational stiffness to the elastomeric member 402 during insertion.

Figure 27A:
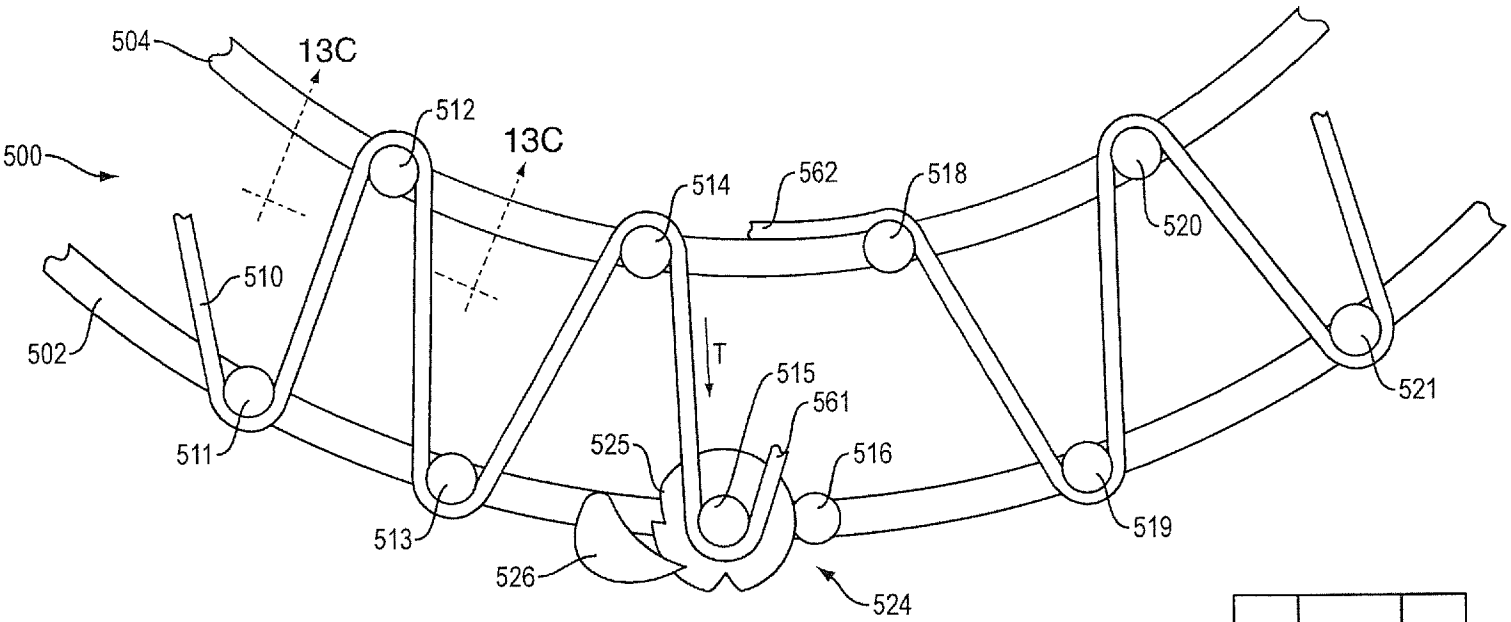
FIG. 27A is a partial cross-sectional view of another impact protection device.
Figure 27C:
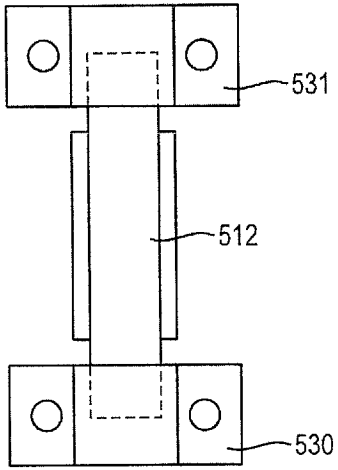
FIG. 27C is a cross-sectional view taken along line A-A of FIG. 27A.
Figure 27B:
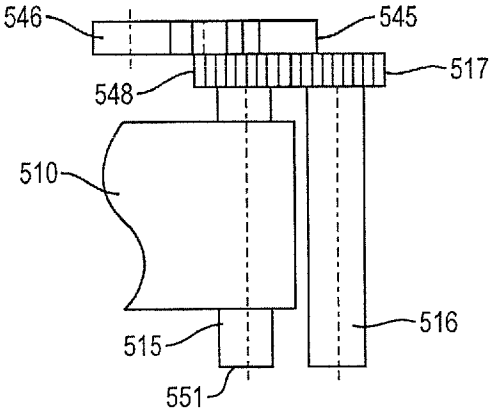
FIG. 27B is an end view of a portion of FIG. 27A.

Another example is shown in FIGS. 27A-27C. Impact protection device 500 includes outer shell 502 and inner shell 504. Elastomeric spring 510 connects the shells. Spring 510 is a continuous thin elastomeric sheet with ends 561 and 562. End 562 is fixed to shell 504 while end 561 is free. Spring 510 is threaded over rollers 511, 513, 515, 519 and 521 that are carried by outer shell 502, and rollers 512, 514, 518 and 520 that are carried by inner shell 504. The rollers allow the spring to move relative to the shells. One roller 512 is shown in FIG. 27C; the roller can move within retainers 530 and 531 that are fastened to the shell. Other mechanical means of carrying rollers or equivalent structures over which the spring can move (such as a low-friction stationary surface) are also contemplated herein.

Device 500 further includes mechanism 524 that allows for adjustment of the tension "T" on spring 510. In this non-limiting example this is accomplished with nip rollers 515 and 516, FIGS. 27A and 27B, through which elastomer 510 passes. The nip rollers grip the elastomer to hold it in place under normal loads expected under normal impacts that are expected. Rollers 515 and 516 are coupled such that they move in unison and in opposite directions, in this case with meshed gears 517 and 548 that are each coupled to one of the rollers. This allows one roller to be turned to tighten or loosened the spring as a means to adjust the spring preload tension. A ratchet consisting of toothed wheel 525, 545 that is coupled to one of the nip rollers, along with pawl 526, 546, inhibits the elastomer from being pulled back through the nip rollers when impact on the outer shell occurs. End 551 of roller 515 is configured (e.g., with a hex nut) such that a torque wrench can be coupled to it, so that the pretension can be set as desired. This will allow the device to be calibrated to an initial preload force.

Pre-tensioning of the elastomer(s) helps to ensure that all shell motion occurring on impact results in stretching of the elastomer(s) (spring(s)) and absorption of impact energy. A second or more additional elastomers can be added in parallel with spring 510. This can have a higher or lower spring constant and can be pre-tensioned as desired. The multiple springs can be selected and tensioned to achieve a desired blended energy absorption result. For example, a second elastomer could have a higher spring constant and set such that it was stretched under greater impacts, to provide more damping during higher impact events.

Another option, not shown in the drawings, would be to include a circuit that recorded the number of impacts to the device that exceeded the energy-absorption capacity. This could be accomplished by including a network of conductors on the outside of the inner shell and on the inside of the outer shell, arranged such that electrical contact occurred between the two networks when the shells touched (which would happen when the energy absorption members were taxed beyond their capacity). A simple circuit would be included to both measure continuity and record the data; the circuit would likely include a battery and a controller with memory. The conductors could be accomplished with thin copper strips similar to ribbon cables, or other conductors. The conductors could be arranged in a criss-cross or hatched pattern such that electrical contact was made when the shells touched even if the alignment between the shells changed due to oblique blows that twisted the outer shell, and the like.

While various embodiments of the innovation have been particularly shown and described, it will be understood by those skilled in the art that various changes in form and details may be made therein without departing from the spirit and scope of the innovation as defined by the appended claims.

What is claimed is:

1. An impact protection device, comprising:

a first shell configured to be disposed on a body portion of a user;

a second shell spaced at a distance from the first shell; and at least one energy absorption subassembly disposed between the first shell and the second shell, the at least one energy absorption subassembly comprising a first component, a second component spaced at a distance from the first component, and a plurality of elastomeric members spanning the distance between the first component and the second component, each elastomeric member of the plurality of elastomeric members having a first end and an opposing second end, the first end coupled to the first component and the first shell and the second end coupled to the second component and the second shell, the plurality of elastomeric members being configured to stretch between the first component and the second component in response to a translation of the second shell relative to the first shell and at a location that is substantially opposite to an impact receiving location of the second shell;

the first component defines a plurality of openings extending between an inner wall and an outer wall of the first component;

the first component comprises a plurality of first component clamping mechanisms, each first component clamping mechanism of the plurality of first component clamping mechanisms disposed within a corresponding opening of the plurality of openings defined by the first component, the first component clamping mechanism of each opening of the first component configured to secure a portion of a first end of an elastomeric member, of the plurality of elastomeric members, disposed within the opening defined by the first component;

each first clamping mechanism of the plurality of first component clamping mechanisms comprising corrugations within each opening of the plurality of openings defined by the first component, the corrugations defining a width of each opening of the plurality of openings of the first component as less than a width of the first end of the corresponding elastomeric member;

the second component defines a plurality of openings extending between an inner wall and an outer wall of the second component; and the second component comprises a plurality of second component clamping mechanisms, each second component clamping mechanism of the plurality of second component clamping mechanisms disposed within a corresponding opening of the plurality of openings defined by the second component, the second component clamping mechanism of each opening of the second component configured to secure a portion of a second end of the elastomeric member, of the plurality of elastomeric members, disposed within the opening defined by the second component;

each second clamping mechanism of the plurality of second component clamping mechanisms comprising corrugations within each opening of the plurality of openings defined by the second component, the corrugations defining a width of each opening of the plurality of openings of the second component as less than a width of the second end of the corresponding elastomeric member.

2. The impact protection device of claim 1, wherein each elastomeric member couples the first component to an outer location of the first shell and couples the second component to an inner location of the second shell.

3. The impact protection device of claim 1, wherein the first end of each elastomeric member comprises a terminal portion, a first end portion of the first end disposed within a corresponding opening defined by the first shell and the terminal portion disposed on an inner wall of the first shell.

4. The impact protection device of claim 1, wherein the second end of each elastomeric member comprises a terminal portion, a second end portion of the second end disposed within a corresponding opening defined by the second shell and the terminal portion disposed on an outer wall of the second shell.

5. The impact protection device of claim 4, wherein:

the outer wall of the second shell defines a set of recesses, each recess disposed in proximity to each corresponding opening, the terminal portion of the second end of each elastomeric member disposed within a corresponding recess of the set of recesses.

6. The impact protection device of claim 1, wherein each elastomeric member of the set plurality of elastomeric members comprises:

a first leg disposed between a terminal portion of the first end and a terminal portion of the second end; and a second leg disposed between a terminal portion of the first end and a terminal portion of the second end, the first leg, the second leg and the terminal portion of the first end defining an opening there between.

7. The impact protection device of claim 6, wherein:

at least one elastomeric member of the plurality of elastomeric members comprises the first leg and the second leg defining a first length; and at least one elastomeric member of the plurality of elastomeric members comprises the first leg and the second leg defining a second length, the second length distinct from the first length.

8. The impact protection device of claim 6, wherein:

at least one elastomeric member of the plurality of elastomeric members comprises the first leg and the second leg defining a first thickness; and at least one elastomeric member of the plurality of elastomeric members comprises the first leg and the second leg defining a second thickness, the second thickness distinct from the first thickness.

9. The impact protection device of claim 1, wherein:

the first component of the at least one energy absorption subassembly comprises a first ring; and the second component of the at last one energy absorption subassembly comprises a second ring spaced concentrically from the first ring.

* * * * *